US006179415B1

(12) United States Patent
Okazaki et al.

(10) Patent No.: US 6,179,415 B1
(45) **Date of Patent: *Jan. 30, 2001**

(54) INK TANK CARTRIDGE

(75) Inventors: Takeshi Okazaki, Sagamihara; Masami Ikeda, Yokohama; Tsutomu Abe, Isehara; Toshio Kashino, Chigasaki; Masahiko Higuma, Togane; Hiroki Tajima, Kawasaki; Hiroyuki Ishinaga, Tokyo; Yoichi Taneya, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/289,209

(22) Filed: Aug. 12, 1994

(30) Foreign Application Priority Data

Aug. 19, 1993 (JP) ..... 5-205224
Jul. 11, 1994 (JP) ..... 6-182828

(51) Int. Cl.[7] ..... B41J 2/175; B41J 2/14
(52) U.S. Cl. ..... 347/86; 347/49
(58) Field of Search ..... 347/86, 87, 85, 347/84, 49

(56) References Cited

U.S. PATENT DOCUMENTS

| | | | | |
|---|---|---|---|---|
| 4,635,080 | * | 1/1987 | Watanabe | 347/49 |
| 4,664,708 | * | 5/1987 | Allen | 346/100 |
| 4,695,824 | * | 9/1987 | Tazaki | 347/86 |
| 4,719,475 | | 1/1988 | Kiyohara et al. . | |
| 4,775,871 | | 10/1988 | Abe et al. . | |
| 4,831,389 | * | 5/1989 | Chan | 347/86 |
| 4,920,362 | * | 4/1990 | Cowger | 347/87 |
| 5,051,759 | | 9/1991 | Karita et al. . | |
| 5,119,115 | | 6/1992 | Buat et al. . | |
| 5,138,342 | | 8/1992 | Kurata et al. . | |
| 5,148,194 | | 9/1992 | Asai et al. . | |
| 5,155,502 | | 10/1992 | Kimura et al. . | |
| 5,156,472 | * | 10/1992 | Suzuki et al. | 347/86 |

(List continued on next page.)

FOREIGN PATENT DOCUMENTS

| | | | | |
|---|---|---|---|---|
| 0379151 | | 7/1990 | (EP) . | |
| 0408241 | | 1/1991 | (EP) . | |
| 0488829 | | 6/1992 | (EP) | B41J/2/175 |
| 0490579 | | 6/1992 | (EP) | B41J/2/175 |
| 488829A2 | * | 6/1992 | (EP) | 347/87 |
| 0493058 | | 7/1992 | (EP) | B41J/2/175 |
| 0529625 | | 3/1993 | (EP) | B41J/2/175 |
| 0529879 | | 3/1993 | (EP) . | |
| 0542247 | | 5/1993 | (EP) . | |
| 542247 | | 5/1993 | (EP) . | |

(List continued on next page.)

*Primary Examiner*—N. Le
*Assistant Examiner*—Judy Nguyen
(74) *Attorney, Agent, or Firm*—Fitzpatrick, Cella, Harper & Scinto

(57) ABSTRACT

An ink-tank cartridge has a first storage chamber housing a negative pressure generating member and having an atmosphere communicating portion communicated with the atmosphere, a second storage chamber in substantially enclosed condition and communicated with the first storage chamber only through a fine communicating portion located remote from said atmosphere communicating portion, and directly storing an ink to be supplied to the first storage chamber, the second storage chamber being arranged adjacent the first storage chamber; and an enclosed ink storage portion only communicated with the second storage chamber and located at respective side surfaces of the first and second storage chambers. The bottom surface of the enclosed ink storage portion is located at higher position than the bottom surface of the first and second storage chambers.

30 Claims, 11 Drawing Sheets

U.S. PATENT DOCUMENTS

| | | | | |
|---|---|---|---|---|
| 5,182,581 | | 1/1993 | Kashimura et al. . | |
| 5,185,615 | | 2/1993 | Koitabashi et al. . | |
| 5,368,402 | * | 11/1994 | Takahashi et al. | 347/87 |
| 5,408,746 | * | 4/1995 | Thoman et al. | 347/49 |
| 5,509,140 | | 4/1996 | Koitabashi et al. | 347/86 |
| 5,521,624 | * | 5/1996 | Matsuda et al. | 347/87 |

FOREIGN PATENT DOCUMENTS

| | | | |
|---|---|---|---|
| 0580433 | 1/1994 | (EP) | B41J/2/175 |
| 2268910 | 1/1994 | (GB) . | |
| 2268911 | 1/1994 | (GB) | B41J/2/175 |
| 64-9279 | 1/1989 | (JP) . | |
| 1103482 | 4/1989 | (JP) . | |
| 02000522 | 1/1990 | (JP) . | |
| 2-55184 | 2/1990 | (JP) . | |
| 02198861 | 8/1990 | (JP) . | |
| 3140376 | 6/1991 | (JP) . | |
| 4-156339 | 5/1992 | (JP) . | |
| 4-185355 | 7/1992 | (JP) . | |
| 4-342774 | 11/1992 | (JP) . | |
| 6-40043 | 2/1994 | (JP) . | |
| 7-52404 | 2/1995 | (JP) . | |

* cited by examiner

INK TANK CARTRIDGE

BACKGROUND OF THE INVENTION

1. Field of the Invention

The present invention relates to an exchangeable, composite and integrated ink-tank cartridge which is connected to an ink-jet head and storing an ink to be supplied thereto, and an ink-jet recording apparatus employing the ink-tank cartridge. The present invention further relates to an ink-tank cartridge having a specific internal structure, provides an ink jet head and a printer which use the ink-tank cartridge, and is applicable for recording apparatuses such as copy machine, facsimile and so forth, communication apparatuses, office work apparatuses, composite apparatuses, printer and so forth, employing an ink-jet technologies.

2. Description of the Related Art

In the recent years, ink-jet recording apparatus have been progressively made compact and have been proposed in variety of configurations adapting to manner of use in personal basis. In particular, in the case of the recording apparatus for personal use, such a type of apparatus employing an integrated exchangeable cartridge, in which a recording head portion and an ink tank portion are integrated as a single unit, is becoming a preferred configuration for compact construction and low cost. In such apparatus, monochrome recording (principally recording characters) type apparatus employing only black ink have been majority. However, even in such apparatus for personal use, variety of manners of use have been developed to raise demand for color recording (including multi-tone recording) or full-color recording.

Most easy construction for performing such color recording is to prepare necessary number of carriage mounting head-tank integration type cartridge, and to mount the head-tank integration type cartridges filled with necessary color inks on the carriages. In such construction, the carriage is, however, required for each of the head-tank integration type cartridge to be mounted to make the entire apparatus bulky.

On the other hand, Japanese Patent Application Laying-open No. 198861/1990 proposes an ink tank cartridge, in which the recording head portion and the ink tank portion can be separated in order to effectively use a recording head which has much longer life than ink contained in an ink tank. Also, in the above-identified publication, there is proposed an integrated construction of an ink tank cartridge portion for four colors (yellow, magenta, cyan and black) for performing color recording.

However, in such four colors integrated type ink tank cartridge, frequencies of use of the colors are differentiated depending upon an image for color recording. Typically, consuming rate of black ink in formation of the image is higher than those of other color inks, it is inherent to exchange the ink tank cartridge while inks other than black are remained in significant amount.

On the other hand, such exchangeable type ink tank, increased frequency of exchanging of the ink tank should cause increasing of amount of bubble externally penetrating into the ink-jet recording head and a joint portion of the ink tank. Such bubble tends to increase of instability of jetting in the ink-jet recording head.

Also, greater frequency of exchanging of the ink-jet recording head increases possibility of damaging a filter provided in the joint portion between the ink-jet recording head and the ink tank.

Furthermore, in the case of multi-density recording, inks having different densities are employed for image recording to realize multiple gray scale. In this case, frequency of pale ink for forming a highlight portion of the image becomes high to cause similar problem to the color recording.

On the other hand, in consideration of more customization in personal use, use of special color should be taken into account. In such case, the preliminarily packaged ink tank cartridge should not satisfy the demand for use of the special color.

Through study of internal construction of the ink tank cartridge with respect to the overall structure, there is no effective prior art documents in viewpoint of exchanging ability or down-sizing of the apparatus. As a prior art document, Japanese Patent Application Laying-open No. 522/1990 discloses a cartridge employing a construction, in which the ink cartridge is substantially adapted to only store the ink, in relation to the overall construction. The document discloses an integrated ink cartridge which has a primary ink storage portion positioned at upper side and only storing a large amount of ink, an ink-jet recording head positioned at lower side, and a little porous member positioned between the ink-jet recording head and the ink storage portion. The disclosed invention features in that since the porous member is not enclosed within the ink storage portion and arranged only in the ink flow path, use efficiency of the ink is improved. In addition, by defining a secondary ink storage portion as a space for storing the ink at the side of the porous member, a negative pressure exerted to the recording head during recording can be maintained substantially constant by storing the ink flowing from the primary ink storage portion due to expansion of air within the primary ink storage portion upon rising of the temperature (lowering of the pressure).

However, in the invention disclosed in the above-identified document, the porous member is excessively wetted by the ink from the primary ink storage portion positioned at the upper side and storing a large amount of ink, the porous member per se have substantially no negative pressure. Therefore, the ink may spills through an orifice of the ink-jet recording head even at small impact. Therefor, the disclosed ink cartridge is not suitable for practical use. In addition, when the exchangeable ink cartridge, in which the ink container is installed to the ink recording head, is applied to the disclosed construction, it may cause spill out of the ink through the porous member and thus cannot be applicable in practical use.

On the other hand, an ink cartridge, in which the ink is enclosed in a bag and the bag is associated with a spring construction for maintaining the negative pressure in the bag constant, has been knows. However, such construction is expensive. Furthermore, it is difficult to manufacture the spring construction with maintaining the performance thereof.

In any case, as the ink cartridge of prior art for the ink-jet (non-contact recording type) recording apparatus which is reasonable in price and satisfactory in technical level, have not been available.

The applicant had made study for the following items in addition to the problems in the exchanging of the ink tank in the prior art. As an ink container suitable for application in a technical field of the ink jet printer, is required to smoothly supply the ink in corresponding amount to that ejected from the recording head during printing, and not to cause leakage of the ink while not in use. Study has been made in the viewpoint for satisfying both requirement. As a result of study, it has been found that it is important premise for the characteristics of the ink-jet to have a construction including a first storage portion housing a negative pressure generating member and having an atmosphere communicating portion communicated to the atmosphere, and a second storage portion communicated with the first storage portion and directly storing the ink for supplying to the first storage portion in substantially enclosed condition, as a basic construction.

On the other hand, the applicant has made review about technical uniqueness of the ink jet printer field by studying contact type recording technology different from the technical field, in which the present invention is involved. Typically, a pen for a recording equipment for performing recording by contacting with a recording medium, supplies the ink for a recording core having ink absorbing ability and ink holding ability. Therefore, this type of recording core is premised to be exposed to the atmosphere and thus inherently requires an ink impregnating body held in saturated condition with the ink in the region directly contacting with the recording core. Namely, the contact recording technology is thoroughly different from the technical content of the ink jet field.

Through a search, Japanese Utility Model Application Laying-open No. 16385/1982 has been uncovered. This publication discloses a pen for a recording equipment taking a premise of employment of a recording core (porous ink absorbing core) for contacting on the recording medium to perform recording.

The invention disclosed in the above-identified publication includes a first absorbing member contacting with a recording core placed at the lower side and a second absorbing member slightly absorbing the ink at the side communicating with the atmosphere but having lower ink absorbing characteristics than the first absorbing member, and also includes a center chamber projecting the recording core downwardly and an enclosed ink storage chamber for supplying the ink at both sides of the center chamber, as essential elements. With the disclosed construction, when the environmental temperature rises to cause expansion of the air in the enclosed ink storage chamber to flow out the ink, the ink reaches the first absorbing member and the extra amount of ink which cannot be held by the first absorbing member may be absorbed by the second absorbing member so that the ink may not spilled from the recording core. The above-identified publication further discloses a given width of groove extending between lowermost end to uppermost end of a side surface different from a partitioning wall between the central chamber and the enclosed ink storage chamber for relieving extra volume of air generated due to thermal expansion to the atmosphere communication opening when one of two enclosed ink storage chamber becomes empty to store only air.

The inventors made attempt to apply the tank construction set forth above to the non-contact recording type ink-jet head which has a little technical similarity, and found new problem of spilling out of ink through the atmosphere communication opening according to variation of the environmental condition. Furthermore, the first absorbing member as the ink impregnating body in saturating condition with the ink loaded in the region to directly contact with the recording core is not require negative pressure and thus is not in common to the ink-jet technology. Such new problem has not been recognized in the field of pen for the recording equipment and has no technical suggestion for stabilizing the negative pressure.

It is further confirmed that the given width of the groove in the above-identified publication has the function for promoting discharging the air together with the ink so that it may further promote spilling out the ink through the atmosphere communication port. Furthermore, ink consumption from the ink storage chambers at both sides are not even. Therefore, it becomes impossible to perform ink-jet recording once the ink in one of the ink storage chamber is spent out, despite of the fact that relatively large amount of ink is remained in the other ink storage chamber. This clearly wastes ink in the ink storage chamber and borders achievement of the task of the ink-jet technology. This problem is caused by penetration of a large amount of air in the first absorbing member resulting in blocking of supply of the ink.

There is a commonly assigned invention directed to a novel ink-tank cartridge which can solve the problems set out above. The invention is to provide an effective function for the ink jet in the base construction including the first storage chamber housing the negative pressure generating member and having the atmosphere communicating portion for communicating with the atmosphere, and the second storage chamber communicating with the first storage chamber with substantially maintaining the enclosed condition and directly storing the ink to be supplied to the first storage chamber. With the proposed construction, since the tank body has a construction to maintain the negative pressure substantially constant in the most period from initiation of use of the ink cartridge to the end of use, it becomes possible to provide the replaceable ink cartridge, the ink-jet head and the printer suitable for relatively high speed recording.

The inventors of the present invention have attempted to provide an ink tank cartridge which can improve an ink storage chamber of a carriage mount type ink tank cartridge having the construction in commonly assigned invention, and permits further down-sizing of an ink-jet apparatus. In the attempt, when a further ink storage chamber is added to the ink tank having the first and second storage chambers, the size of the apparatus is increased if the additional ink chamber is provided at the rear side of an ink supply portion. On the other hand, when the additional ink chamber is provided at the lower side of the ink supply portion, the amount of the ink to be remained in the additional ink chamber is increased. Furthermore, when the additional ink chamber is provided at the upper side, ink supply speed corresponding to water head difference between the ink in the first storage chamber and the enclosed second storage chamber and the ink in the additional ink chamber upon gas-liquid exchange so as to make ink supply unstable due to leakage of the ink and variation of the ink absorbing region in the absorbing body when environmental condition is varied.

SUMMARY OF THE INVENTION

It is an object of the present invention to provide an ink tank cartridge which can improve an ink storage chamber of a carriage mount type ink tank cartridge having the construction in commonly assigned invention, and permits further down-sizing of an ink-jet apparatus.

When an additional ink chamber is provided, a new problem is arisen in that an ink supply characteristics tends to be varied according to variation of a natural vibration frequency of a tank. It is another object of the present invention to provide an ink tank of a desired configuration with solving the problem set forth above.

Also, when the additional ink chamber is provided, it becomes necessary to provide reasonable overall construction of a partitioning portion which can prevent strength of the tank from lowering, to improve the ink supply characteristics, and to set a bottom area of the additional ink chamber for reducing remaining amount of the ink, and a gap position for improving ink supply characteristics of the partitioning portion of the additional ink chamber and improving the gas and liquid exchanging efficiency.

It is a further object of the present invention to provide an ink-jet apparatus which can achieve reduction of frequency of exchanging and improvement of installation ability of the ink tank for permitting stable ink supply.

Nevertheless, it is an object of the invention to provide an ink-jet apparatus and an ink tank cartridge to be employed in the ink-jet apparatus, which can solve at least one of the problems in the background arts.

On the other hand, in the premised basic construction of the ink cartridge including the first storage chamber housing the negative pressure generating member and having the atmosphere communicating portion for communicating with the atmosphere, and the second storage chamber communicating with the first storage chamber with substantially maintaining the enclosed condition and directly storing the ink to be supplied to the first storage chamber, (which construction will be hereinafter referred to as "premised basic construction"), when an ink having a high surface tension is filled, leakage of ink is to be caused in unknown reason. This is the new phenomenon which has not be expected in the prior art. Necessity of analysis of this phenomenon for providing higher reliability of the ink cartridge has been newly recognized by the inventors.

A further object of the present invention is to provide a refill ink for initial filling and refilling which can make the characteristics of the cartridge construction having two storage chambers more stable and is novel for the ink cartridge for ink jet, in view of the background art.

A still further object of the present invention is to provide an ink tank cartridge and an ink-jet apparatus which can reduce possibility of penetration of bubble and damaging of a part of filter of a recording head, which is caused upon replacing of the cartridge otherwise, facilitate exchanging of an ink tank, removes factor to cause instability of jetting to make stable formation of an image possible, and permits color recording without causing increasing of the size of the ink-jet apparatus and to provide compatibility for a single color ink tank cartridge and at least two color or at least multiple volume ink tank cartridge.

A yet further object of the present invention is to provide an ink-jet apparatus having a carriage detachably mounting an ink tank cartridge which makes it possible to supply an ink for a plurality of recording heads, which carriage detachably mounts respective of a first ink tank integrating a plurality of ink tanks for black ink and a second ink tank integrating ink tanks for three color inks other than black ink, the first and second ink tanks being provided an engaging portion for projection-and-recess engagement at the engaging portion, and whereby to achieve reduction of the frequency of exchanging of the ink tank cartridge, to improve installation ability and to achieve stable ink supply.

A still further object of the present invention is to provide an ink tank cartridge having the first storage chamber housing the negative pressure absorbing member and having the atmosphere communicating portion communicated with the atmosphere and the second storage chamber communicated with the first storage chamber via only a fine communicating portion with substantially maintaining enclosed condition and directly storing the ink to be supplied to the first storage chamber, in which an ink storage enclosed portion communicated with only second storage chamber at the side of the first and second storage chambers, and whereby can achieve down-sizing of the overall construction, avoid ink supply failure and avoid problem of the meniscus level difference.

A further object of the present invention is to provide the ink tank cartridge which is carried by the carriage provided with a partitioning member and has a recess for accommodating the partitioning member between the first and second storage chambers and the ink storage enclosed chamber for facilitating positioning thereof with respect to the carriage and achieving accuracy in connection with the head side connecting portion of the ink cartridge with maintaining freedom.

The present invention is proposed for achieving the above-mentioned objects, and thus, an ink tank cartridge having a plurality of recording head to be supplied inks and adapted to be mounted on a carriage having partitioning members for permitting independent detachable mounting, comprises at least two ink tank cartridges integrated with each other, and a groove for accommodating the partitioning member for permitting detachable mount of the integrated ink tank cartridges on the carriage with the partitioning member.

The objects is also achieved with an ink-jet apparatus comprising a carriage having a partitioning member for independent mounting of ink tank cartridges supplying inks for a plurality of recording heads, an integrated ink tank cartridge, in which at least two individual ink tank cartridges are integrated, having a groove to accommodate the partitioning member for detachably mounting of the integrated ink tank cartridge on the carriage, the integrated ink tank cartridge being connected to the recording head as mounted on the carriage.

Namely, in the present invention, there is provided an ink tank cartridge and an ink-jet apparatus capable of performing color recording without causing increasing of the size of the apparatus, in which an ink tank cartridge containing a single color and an ink tank cartridge containing at least two color inks or multiple volume of ink can be interchangeably installed.

The preferred construction of the present invention are as follows:

the fine communicating portion is defined between a partitioning wall separating the first and second storage chambers and the inner surface of the ink-jet cartridge, and an ink supply opening is defined on the surface of the first storage portion opposing to the partitioning wall;

the fine communicating portion is defined between a partitioning wall separating the first and second storage chambers and the inner surface of the ink-jet cartridge, and an ink supply opening is defined on the surface of the first storage portion opposing to the partitioning wall, the ink supply opening permitting insertion of a supply tube of the ink-jet head, the negative pressure generating member in the vicinity of the ink supply opening being a compressible region to be compressed toward the fine communicating opening by insertion of the supply tube, and the ink being filled in the negative pressure generating member in the first storage portion, the second storage chamber and the enclosed ink storage portion;

the ink-tank cartridge has a volume ratio of the sum of volume of the second storage chamber and the enclosed ink storage portion versus that of the first storage chamber in a range of 1:3 to 1:1; and the ink-tank cartridge has a gas-liquid exchange promoting structure extending from the fine communicating portion to the position opposing to the negative pressure generating member within the first storage chamber, and a gas/liquid interface is defined within the negative pressure generating member.

The preferred construction of the enclosed ink storage portion is one or arbitrary combination of the following constructions:

the ink-tank cartridge has a partitioning wall separating the first and second storage chambers and defining the fine communicating portion, and a partitioning plate positioned within the enclosed ink storage portion and offsetting from an extension of the position of the partitioning wall, the partitioning plate permitting movement of the ink and atmospheric air whereby, the strength can be increased without increasing the thickness of the wall of the tank so that the movement of the ink in response to the external force can be avoided;

the ink-tank cartridge has a partitioning wall separating the first and second storage chambers and defining the fine communicating portion, and a partitioning plate disposed within the enclosed ink storage portion and spaced from the side surface of the first and second storage chambers and having communicating portion at the upper portion, whereby exchanging ability of the ink and atmosphere can be improved and thus the ink supply characteristics can be improved;

the ink-tank cartridge has a atmosphere communicating enclosed path having an opening portion at the upper center portion of the first storage chamber and communicating with the atmosphere communicating opening, whereby the volume of the absorbing body can be reduced and ink storage amount can be increased, and conversely even when the variation of the ink activity is caused due to unexpected external condition, spilling of ink from the atmosphere communication opening can be prevented;

the ink-tank cartridge has ribs for adjusting natural vibration frequency on the side surface of the tank and extending in respective of the first and second storage chambers, whereby the problem of variation of the ink supply characteristics due to variation of the natural vibration frequency can be successfully prevented;

the fine communicating portion is defined between the partitioning wall separating the first and second storage chambers and the inner surface of the ink-tank cartridge, an ink supply opening is defined in the surface of the first storage chamber opposing to the partitioning wall, and the bottom surface of the enclosed ink storage portion of the ink-tank cartridge is located at higher position than the bottom surface of the first and second storage chambers, whereby the ink remained in the ink storage chamber becomes substantially zero, the second storage portion per se can be made more compact in space, ink supply from the second storage chamber to the first storage chamber can be made more efficient, the preferred construction is that the bottom surface of the ink storage portion is located at higher position than the ink supply opening at least in use, and whereby the ink supply can be certainly performed before consuming the ink in the first storage portion to stabilize communication of ink between the first and second storage chambers.

Other objects, advantages and features of the present invention will become clear from the detailed description given hereinafter in terms of the preferred embodiments.

BRIEF DESCRIPTION OF THE DRAWING

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed in terms of the preferred embodiments with reference to the drawings.

(A first embodiment)

Figure 1:
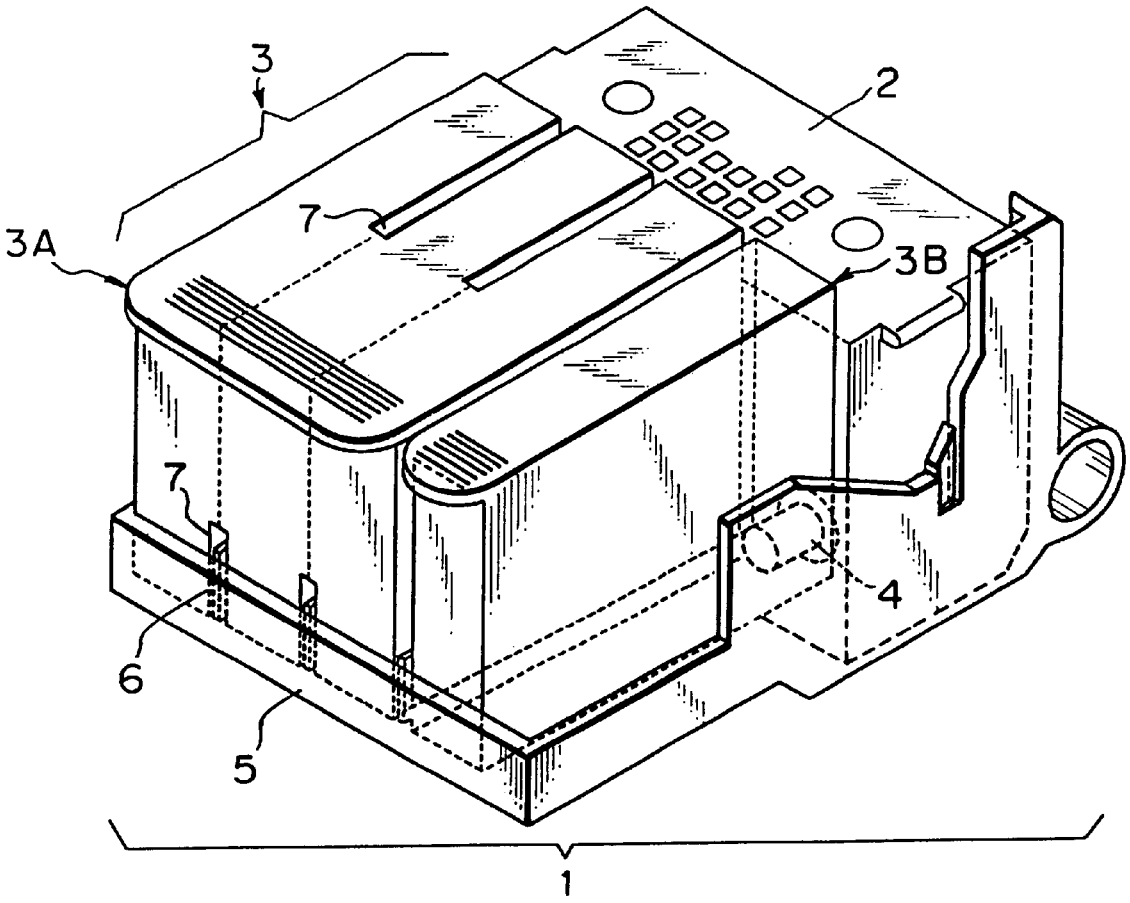
FIG. 1 is a perspective view of one embodiment of an ink tank cartridge according to the present invention.

FIG. 1 is a perspective view showing overall construction of the first embodiment of a replaceable ink tank and head cartridge main body according to the present invention.

As shown in FIG. 1, the shown embodiment of the head cartridge main body 1 has a construction, in which a recording head 2, in which a plurality of ink-jet recording heads are integrated, and an exchangeable ink tank 3. The recording head 2 and the exchangeable ink tank 3 are connected in free-joint at an opening portion 4. The reference numeral 5 denotes a carriage, on which the head cartridge main body 1 is mounted. The reference numeral 6 denotes an engaging portion for projection-and-recess engagement with the carriage. In concrete, the engaging portion 6 comprises ribs provided on the carriage 5 and utilized for space separation and positioning when the exchangeable ink tank is solely set. On the other hand, in the exchangeable ink tank 3, a composite integrated ink tank 3A is formed of rib receptacle grooves 7 so that the ink tank 3A may be set on the carriage 5.

In the shown embodiment, within a composite integrated ink tank cartridge 3A, respective of yellow, cyan and magenta color inks are stored as inks for color recording. On the other hand, in an independently present ink tank cartridge 3B stores a black ink.

By considering the use characteristics in the case of forming the image and making the ink which has different use condition than those of others, other inks having substantially equal use conditions can be integrated. This improves handling ability of the ink tank cartridge.

On the other hand, since the integrated ink tank cartridge is formed with the rib receptacle grooves 7 for engaging with the rib 6 provided on the carriage 5, setting of the integrated ink tank cartridge to three heads, in the shown case, can be certainly performed with utilizing the ribs 6 as guide. Namely, with engaging the ribs 6 and the rib receptacle grooves 7 and pushing the cartridge from the back side toward the head, three opening portions 4 can be simultaneously and certainly connected without causing offset in the position.

Even when such composite integrated ink tank cartridge 3A is employed, since the rib receptacle grooves 7 for accommodating the ribs 6 which are adapted to be used for separating and fixing the individual ink tank cartridges which are not integrated, compatibility to the individual ink tank cartridge can be maintained.

The ribs 6 and the rib receptacle grooves 7 are adapted to loosely fix the ink cartridges 3A and 3B to the carriage 5 to permit certain extent of rocking motion of the ink cartridges. This is because that the connection between the replaceable ink cartridges 3 (3A, 3B) and the recording head 2 is so-called free-joint, in which connecting tubes of the recording heads are simply inserted into the opening 4 of the cartridges. The free-joint contributes improvement of yield and realizes cost-down for facilitating exchanging of the ink cartridges and permitting tolerance in the parts, such as cartridge, carriage and so forth with maintaining certain level of reliability of connection.

In order to maintain the effects set forth above, it is desirable not to completely fix the ink tank to the carriage. However, since the carriage is moved in the direction of alignment of the cartridges upon recording, acceleration in the direction of motion of the carriage acts on the ink cartridges. In such case, a filter provided at the tip end of the connecting tube 4 of the recording head and the negative pressure generating member within the ink cartridge 3 are mutually fitted under a pressure in the free-joint portion. When the acceleration is exerted after installation of the cartridge, displacement of the press fitting point between the filter and the negative pressure generating member can be caused. Repeating such displacement, the negative pressure generating member may be worn. In addition, the dust generated by wearing of the negative pressure generating member may be a cause of blocking of the filter. In addition, it is possible to cause ejection failure by penetration of bubble through the joint portion.

Therefore, it is desirable to depress the surface of the ink cartridge 3 perpendicular to the direction of the acceleration at least at three points to restrict displacement of the press-fitting point, in order to simply fixing the ink cartridge. The ribs 6 and the rib receptacle grooves 7 in the shown embodiment of the invention realizes this to restrict at two or more points at the lower portion of the cartridge. On the other hand, as discussed later in connection with FIGS. 5A through 5C, the upper portion of the tank is restricted one or more points with a rib on a lid.

In the shown embodiment, on the lower portion of the ink cartridge, the displacement is restricted through the overall length of the cartridge. On the other hand, on the upper portion of the ink cartridge, the displacement is restricted through substantially half of the length of the cartridge. Thus, the ink cartridge can be effectively restricted relative to the motion of the carriage.

It should be appreciated that while it is desirable to provide the rib for restricting displacement of the ink cartridge at the position for restricting displacement on the surface perpendicular to the direction of the acceleration acting on the cartridge, it should not be essential to the present invention and is not necessarily perpendicular to the direction of the acceleration but can be at any points as long as the displacement of the cartridge is effectively restricted.

Figure 5A:
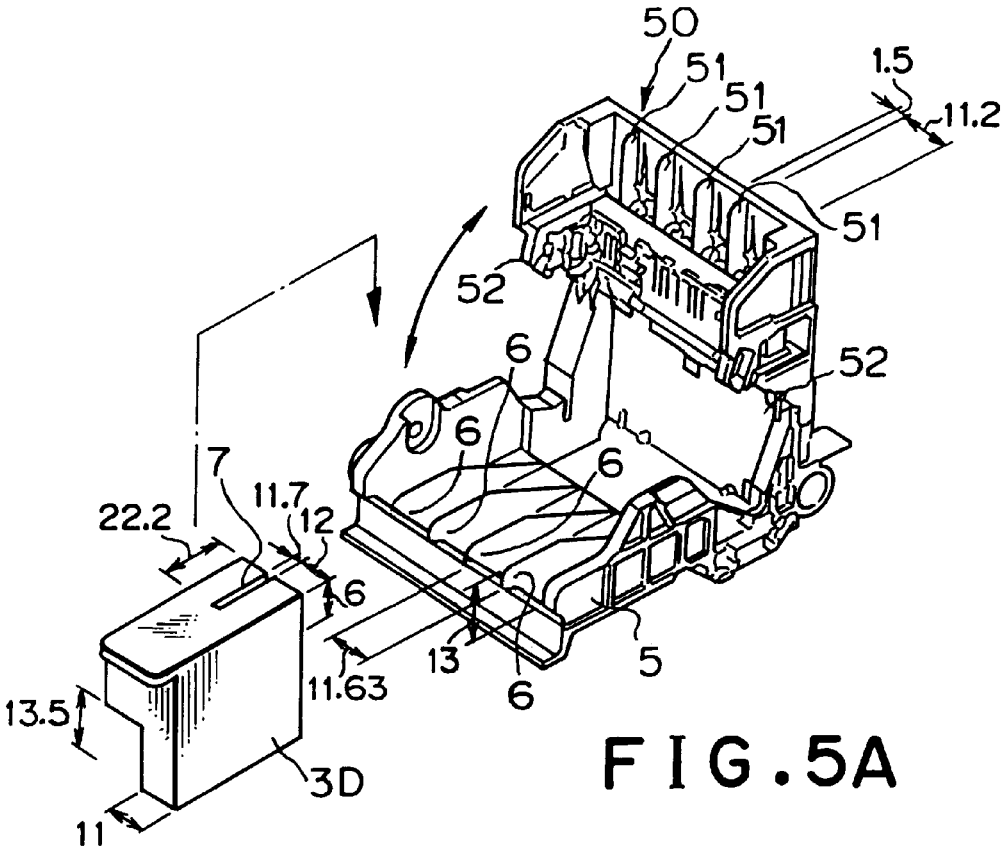
FIGS. 5A, 5B and 5C are explanatory views showing a relationship between a carriage and the ink cartridge in the embodiment of the invention.

FIG. 5A is a perspective view showing overall construction of the carriage, on which the ink cartridge 3 and the recording head unit 2 are mounted.

For the carriage 5, a lid 50 pivoted at both ends of a portion to mount the recording head unit 2 for pivotal motion. The lid 50 covers the ink cartridge 3. The lid 50 has ribs 51 serving as the engaging portion on the back side surface and engaging with the rib receptacle grooves (concave portions) 7 of the ink cartridge 3 set forth with respect to FIG. 1. By this, the ribs 51 contact with the upper portion of the ink cartridge 3 to restrict displacement of the ink cartridge due to acceleration of the carriage motion and so forth. Namely, the ink cartridge can be held more accurately by the projection-and-recess engagement in the engaging portion of the present invention.

Figure 5B:
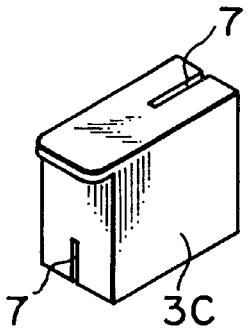
Figure 5C:
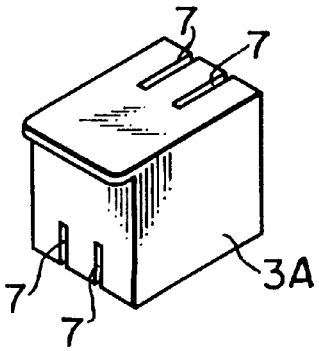

For the carriage 5, the ink cartridges 3D, 3C and 3A in the configurations illustrated in FIGS. 5A, 5B and 5C can be installed, respectively. In such case, as set forth above, the ribs 6 provided on the carriage 5 engage with the rib receptacle grooves 7 provided at the lower portion of the ink cartridge.

It should be noted that relationship between the dimensions of the ribs 6 and 51 of the carriage 5 and the dimension of the rib receptacle groove 7 of the ink cartridge 3D is as illustrated in FIGS. 5A through 5C.

At first, the rib 51 provided on the upper lid 50 of the carriage has a thickness of 1.5 mm at the base portion. Respective of two ribs 51, a clearance of 11.2 mm between the base portions is defined. By this, when the ribs 51 engage the rib receptacle grooves 7, the portion having the width of 12 mm from the side surface of the cartridge is enters into the above-mentioned clearance. At this time, the ribs 51 penetrate in the rib receptacle grooves 7 in a depth of 3 mm through a length of 21 mm versus the 22.2 mm of length of the rib receptacle grooves 7. By this, as set forth above, the ink cartridge is restricted from displacement.

The rib receptacle groove 7 is formed at a position of 12 mm from the side surface of the ink cartridge and has a groove width of 1.7 mm, a depth of 6 mm and the length of 22.2 mm as set forth above.

On the other hand, the height of the rib 6 on the carriage 5 is 13 mm. The upper end of the rib 6 engages with the bottom surface at the portion where the bottom of the cartridge 3D is elevated in the magnitude of 13.5 mm. On the other hand, the interval between the base portions of the adjacent ribs is 11.63 mm. Within a clearance thus defined between the ribs the portion of the cartridge 3D having the width of 11 mm is engaged.

It should be noted that the ink cartridges 3D and 3C shown in FIGS. 5A and 5B are the ink cartridges discussed in other embodiments with reference to FIGS. 2, 3, 4, 7 and 8. Also, the carriage shown in FIG. 5A has four ribs 6 and corresponds to the embodiments of FIGS. 2 and 3, the foregoing discussion in connection with FIGS. 5A–5C should be equally applicable for other embodiments having any number of ribs.

In the shown embodiment, respective of yellow, cyan and magenta color inks are stored in the integrated ink tank cartridge 3A. On the other hand, black ink is stored in the independent individual ink tank cartridge 3B. With this construction, full color recording becomes possible.

On the other hand, it is possible to store inks having the same color and different densities in the integrated ink tank cartridge 3A and the independent individual ink tank cartridge 3B. In particular, by storing further different densities of the same color inks in the integrated ink tank, further greater number of tones can be recorded for better gradation.

Of course, it is possible to use various combination of inks depending upon manner of use by the user.

For instance, it is possible to fill the same ink with lower dye concentration or pigment concentration in the composite integrated ink tank 3A and to fill the ink having the normal concentration or slightly higher concentration of dye or pigment in the independent individual ink tank 3B.

When printing is performed using such combination of the ink cartridge, the highlight portion of the image could be drafted for long period without exchanging the tank.

Also, it is possible to consist the inks in the composite integrated ink tank 3A of inks respectively having lower, very lower and slightly lower dye or pigment concentration than that of the normally used ink, and to fill the ink having dye or pigment concentration twice of the normal ink in the remaining independent individual ink tank 3B. When printing is performed with such combination of ink cartridge, a multi-tone image with excellent gradation can be realized. Also, the frequency of exchanging of the ink cartridge containing the concentration of twice of the normal ink, which is used in higher frequency than others, could be small.

(A second embodiment)

It is possible in certain manner of recording that a specific ink is consumed in greater amount than that of remaining inks. In such occasion, it is desirable to contain the ink to be used in greater amount within the integrated ink cartridge with increased amount.

Figure 2:
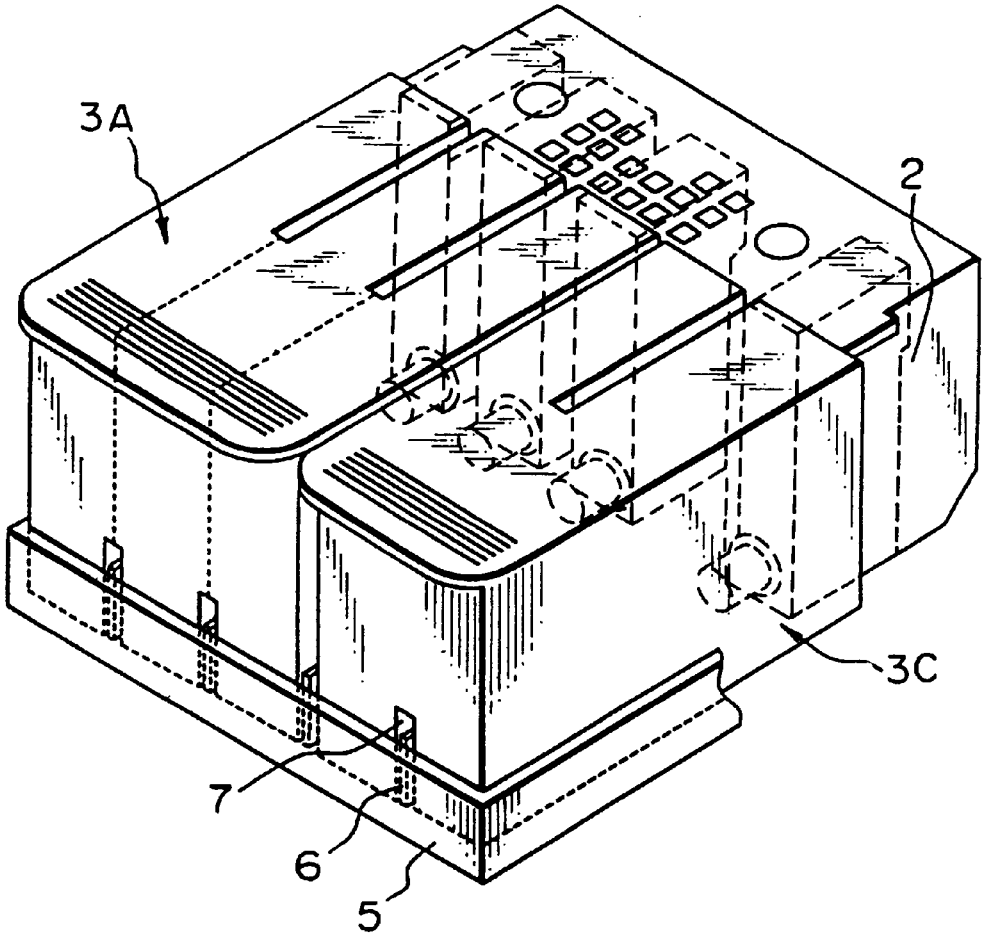
FIG. 2 is a perspective view of another embodiment of an ink cartridge according to the present invention.

For example, as shown in FIG. 2, it is possible to reduce frequency of exchanging of the ink tank cartridge for the ink to be consumed in greater amount, by forming the integrated ink tank cartridge with integrating the integrated ink tank cartridge 3A having three separated chambers for storing three kinds of inks and a large capacity type integrated ink tank cartridge which has a volume capacity of substantially twice of the independent individual cartridge and communicating both volumes. By reducing frequency of exchanging the ink tank cartridge, possibility of penetration of the bubble which can be caused upon exchanging of the ink tank cartridge, can be reduced. Furthermore, reduction of frequency of exchanging the ink tank cartridge may be effective for reducing affect for the filter provided at the joint portion of the head.

(A third embodiment)

Figure 3:
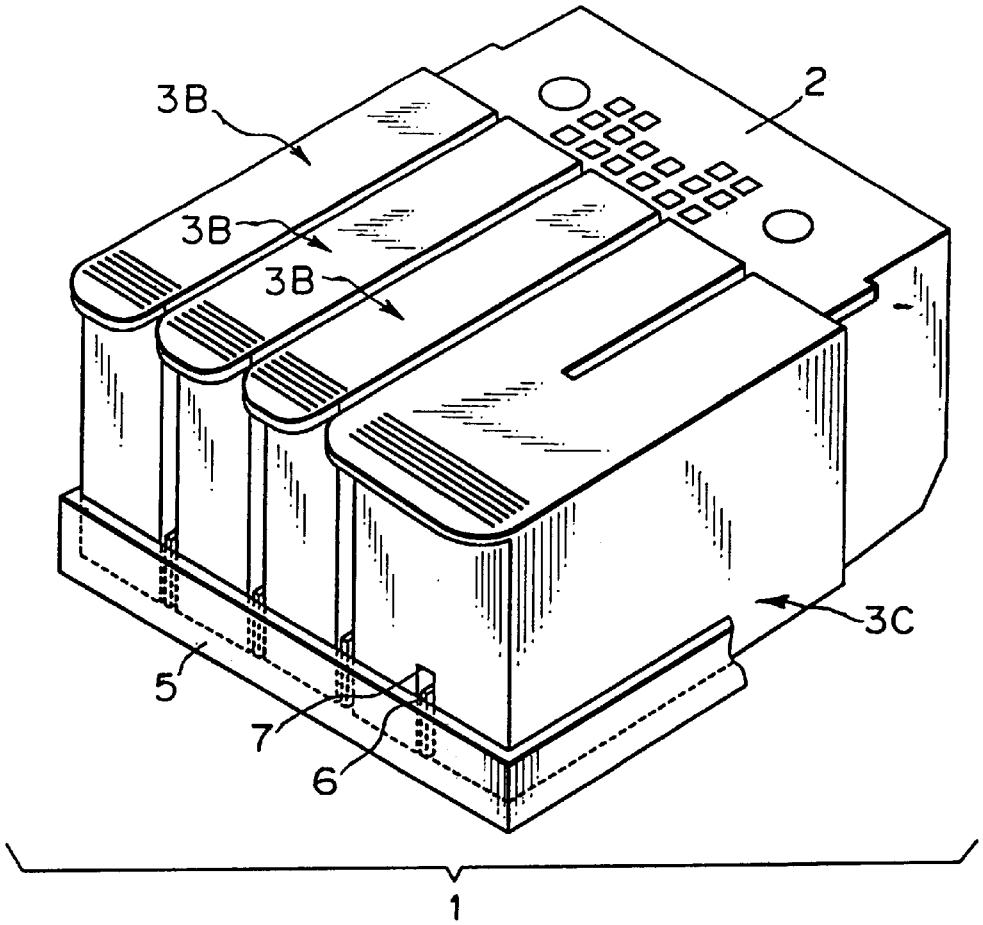
FIG. 3 is a perspective view of a further embodiment of an ink cartridge according to the present invention.

FIG. 3 shows a construction, in which the ink tank cartridge 3C to be used in greater amount is in a form of the integrated ink tank cartridge, and other ink tank cartridges 3B are in a form of the independent individual ink tank cartridges.

With such construction, it becomes possible to adapt the ink tank cartridge for the case where the consumed amount of respective inks fluctuate.

It should be noted that the ink tank cartridge 3C containing substantially twice greater amount is connected to the recording head at the side adjacent the independent individual ink tank cartridge, and the other side of the integrated ink tank cartridge has no connecting portion.

Of course, it is possible to provide connecting portions for connection with the recording heads respectively for the ink tank cartridges in the form integrating two individual ink tank cartridges, and to block one of the connecting portion which is not used for connection by seal or so forth.

(A fourth embodiment)

Figure 4:
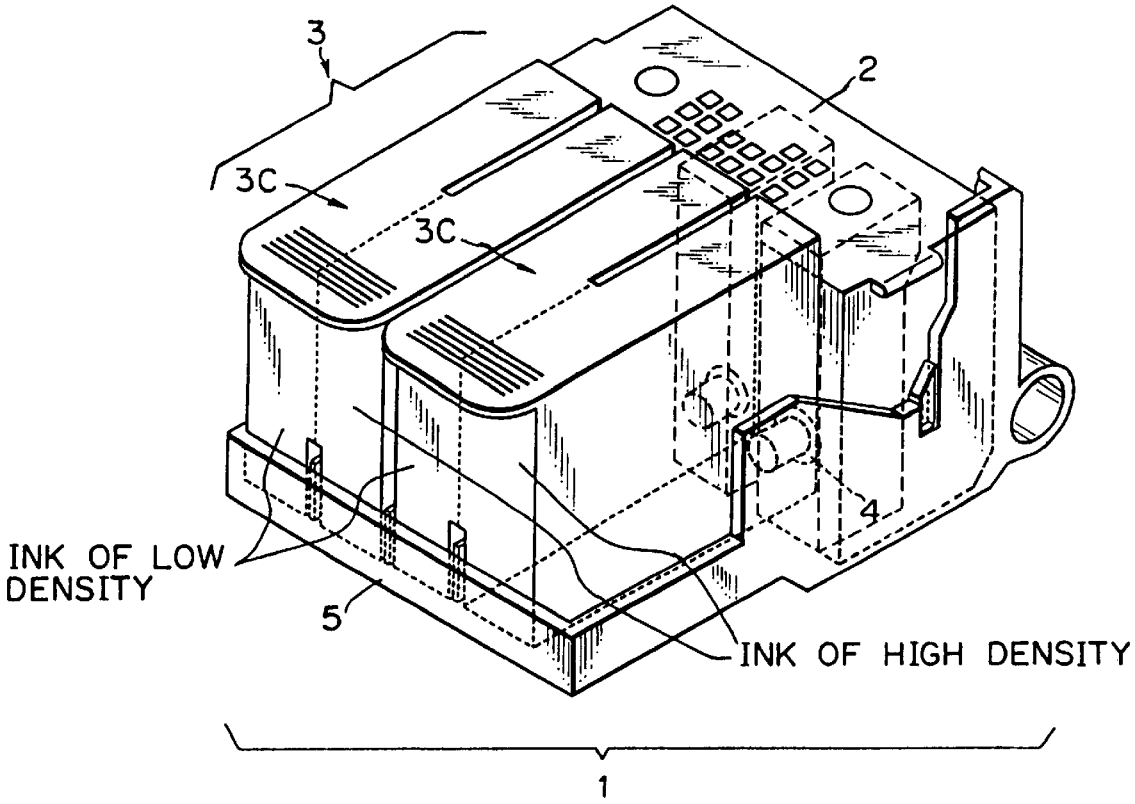
FIG. 4 is a perspective view of a still further embodiment of an ink cartridge according to the present invention.

FIG. 4 shows a construction, in which two integrated ink tank cartridges 3C, in each of which two independent ink tank cartridges are integrated, are employed and connected to the recording heads.

The shown embodiment comprises two sets of exchangeable composite integrated ink tanks, respective sets of ink tanks may contain the same combination of inks. Here, each set of the ink tank cartridge is filled with high tone ink and low tone ink and two recording heads capable of forming three tone image are used in composite manner. This construction make it possible to perform high speed recording and permits exchanging of the ink tank cartridge per each set to facilitate exchanging of the ink tank. By this, the possibility of damaging of the part of the filter of the recording head can be reduced so that the reliability of the recording head can be increased.

On the other hand, it is possible to contain a combination of different inks in respective sets of the ink tanks. For instance, two kinds of color inks of black and cyan may be contained in one set of the ink tanks and two recording heads capable of forming two color image are used in composite form.

It should be noted that, needless to say, it is possible to form the ink tank cartridge by integrating four individual ink tank cartridges. Even in this case, the rib receptacle grooves 7 are, of course, formed between respective storage chambers for respective inks for accommodating the ribs on the carriage.

Such ink tank cartridge can minimize the work load in exchanging the ink tank cartridge and thus is quite effective for a user of the type performing recording for forming image with substantially equal rate of consumption of four color inks.

It should be noted that the form of the ink tank cartridge employed in the present invention may be the type where all of the porous absorbing bodies are stored within the ink tank for storing the ink by absorbing the ink in the absorbing bodies. However, it is preferred to construct the ink tank in the construction discussed hereinafter.

Figure 6:
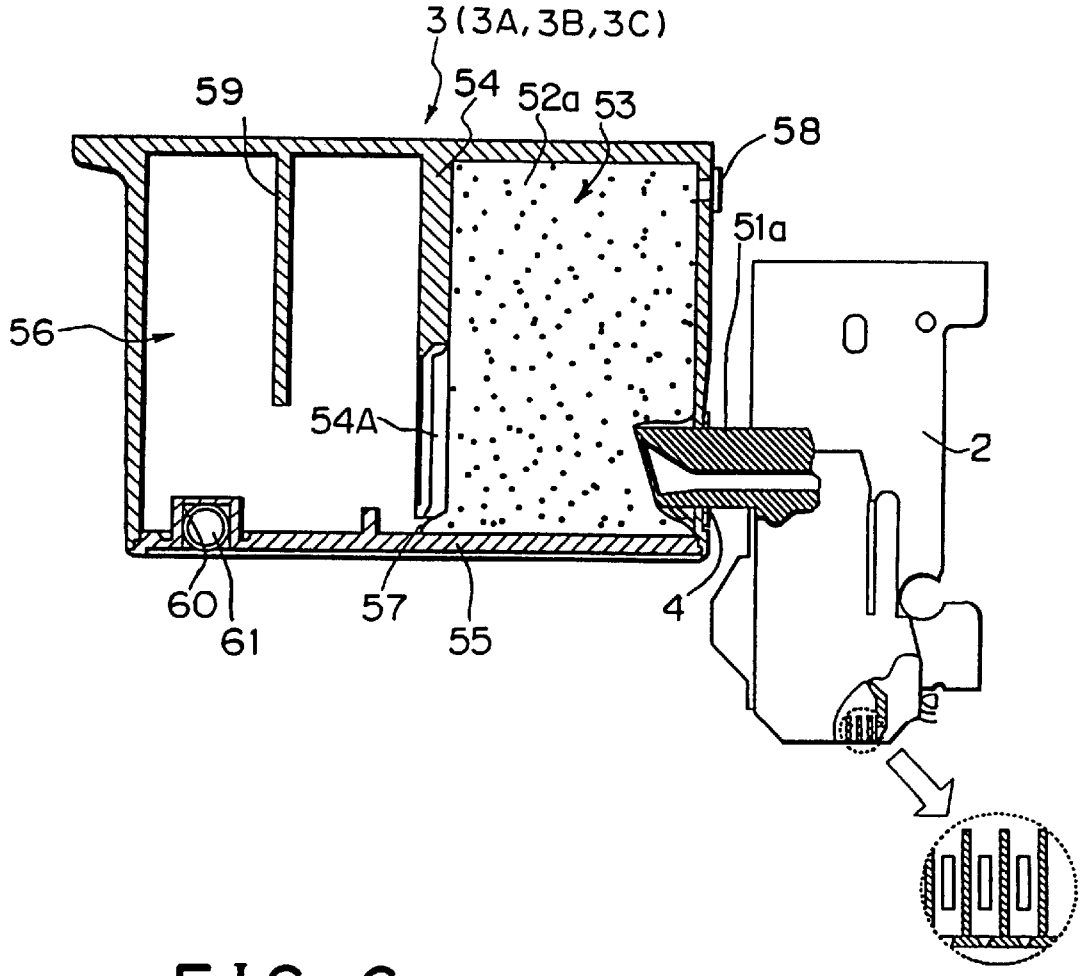
FIG. 6 is a section fragmentarily showing the internal construction of the ink cartridge of the present invention.

Namely, as shown in FIG. 6, the shown embodiment of the ink tank cartridge main body 3A (3B, 3C) comprises a negative pressure generating member housing portion 53 serving as the first storage chamber of the present invention, in which the opening portion 4 for connection with the ink-jet recording head 2 is formed and the negative pressure generating member 52*a* is housed, and an ink storage portion 56 serving as the second storage chamber, placed in adjacent to the negative pressure generating member housing portion across the rib 54, communicating with a communicating portion 57 of the bottom 55 of the ink cartridge and storing the ink.

It should be noted that, in FIG. 6, the reference numeral 58 denotes an atmosphere communicating opening for communicating the negative pressure generating member housing portion 53 to the atmosphere, 59 denotes a rib for reinforcing the strength of the ink storage portion 56, 60 denotes an opening for filling an ink in the ink tank cartridge, and 61 is a sealing member for sealing the opening. On the rib 54, a groove 54A is formed for gas-liquid exchange between the ink in the ink storage portion 56 and the atmospheric air introduced into the negative pressure generating member housing portion 53 via the atmosphere communicating portion 58. By this, the ink in the negative pressure generating member housing portion 53 is initially consumed. When the ink liquid level in the housing portion 53 reaches the groove 54A, the ink in the ink storage portion 56 is supplied to the housing portion 53 via the communicating portion 57 by gas-liquid exchange and thus consumed.

Concerning the construction of the cartridge, for which the refill ink according to the present invention is applied, a part of feature thereof will be discussed hereinafter.

Irrespective of the storage condition and use condition, the premise construction, constructing the region of the negative pressure generating member in the vicinity of the atmosphere communicating portion as the region not holding the ink is advantageous for preventing the ink in the ink cartridge from spilling through the atmosphere communicating portion under variation of the environmental condition. Particularly, in the case where the sealing member seals the atmosphere communicating portion, it is effective for preventing the sealing member from peeling off. Also, in the use condition, this region can efficiently supply the atmospheric air in an amount corresponding to the necessary for the cartridge. The region in the vicinity of the atmosphere communicating portion being completely shut spilling of the ink, is preferred for decelerating the penetration speed of the ink per se. However, the region may be established as a region which is once wetted by the ink preliminarily and then is removed the ink.

On the other hand, the present invention is cable of certainly establish a substantially stable ink supply path within the negative pressure generating body for the ink in the second storage chamber for stable supply of the ink by providing a compressed (or compressible) region compressed or compressible by the ink supply opening or the ink supply tube at the side opposing to the partitioning wall, through which the fine communication portion is formed. The ink supply opening is positioned at the upper position than the fine communication portion with respect to the lower surface of the ink cartridge. It should be noted that the "supply tube" referred to by the present invention should be understood to include not only the insertion tube specific in the ink-jet but also the valve structure and connecting member deforming the negative pressure generating body provided in the cartridge. The effect of such arrangement is to make the direction of movement of the ink substantially constant and permit consumption of all ink in the second storage chamber. Also, even after consumption, by permitting the flow of the atmospheric air from the partitioning wall to the opposite opening for eliminating the negative pressure condition of the air in the second storage chamber, it permits consumption of the ink in the negative pressure generating body and whereby to reduce the amount of ink to be remained.

Particularly, with respect to the above-mentioned premised construction, by providing the region of the negative pressure generating body not compressed by the supply tube and the region of the negative pressure generating body compressed, the uni-directional ink supply path can be defined in the not compressed region to attain the effect set forth above, and by the ink holding capacity of the compressed region, the amount of ink to be remained can be further reduced.

Accordingly, the more preferred construction of the present invention is the construction satisfying the foregoing three requirements. It should be obvious that composite construction of the sole construction and any of two constructions set forth above would provide excellent effect.

On the other hand, the ink-tank cartridge of the premised construction of the present invention is inherently contact with the hand and finger of the user. The ink-tank cartridge may not use any problem in normal use. However, when a large pressure is applied, deformation of the storage chamber storing only ink may be caused though it depends of the size of the chamber. As a solution of the problem of the externally applied pressure, it is desirable to provide partitioning walls at an interval greater than the interval of the partitioning walls, through which the fine communication openings are formed.

As an ink-jet printer of the premised construction of the present invention, it is possible to use the original function of the cartridge for automatically performing discharging of the ink from the cartridge by drawing or discharging by the drawing means view the head since the ink condition in the negative pressure generating body can be adjusted before initiation of printing.

It should be noted that the height of the fine communication portion up to the partitioning wall is preferably greater than the average diameter of the holes of the negative pressure generating member (preferable the average diameter in the vicinity of the fine communication portion) and less than or equal to 5 mm. When it is desired to attain further stability, the height of the fine communication portion is further preferred to be less than or equal to 3 mm. Also, the ratio of the ink storage capacity of the volume of the housing chamber for the negative pressure generating member and the volume of the storage chamber storing only ink is greater than or equal to 1:1 but less than or equal to 1:3, and optimally 1:1.5.

Next, the spilling of the ink as observed in the premised construction, is generally occurred upon initial filling of the ink cartridge and upon refilling the ink cartridge. The cause of such spilling of the ink is that the ink which may not cause problem in the storage chamber, has a greater tendency to spill out though the opening portions, such as the atmosphere communication portion or the ink supply opening or the sealed region by flowing through the clearance between the negative pressure generating portion and the internal wall of the cartridge rather than temporarily held within the negative pressure generating member. Therefore, in the present invention, as a result of study for the ink condition adapted to the premised construction of the present invention, a finding is obtained that the above-mentioned tendency becomes significant when the surface tension of the ink exceeds 55 dyn/cm (25° C.). When the surface tension of the ink is less than or equal to 50 dyn/cm, it may not be influenced by variation of the environment and exhibit quite stable characteristics.

On the other hand, when the surface tension of the ink is less than or equal to 55 dyn/cm, stable propagation characteristics in the negative pressure generating member can be certainly obtained. In the construction where gas/liquid interface between the air as the gas and the ink as the liquid is established within the negative pressure generating member, the interface can be stably maintained for a long period. This is advantageous for the cartridge having a gas/liquid exchange promoting mechanism extending to the position opposing to the negative pressure generating member in the first storage chamber from the fine communication portion, since linear interface can be established in stable condition by cooperative combination of the property of the ink and the constructional function.

Conversely, when the surface tension of the ink for the premised construction is less than 20 dyn/cm (25 C), although spilling of ink may not be caused under normal condition, spilling of the ink can be observed by exertion of the impact. It is found that when the surface tension of the ink is greater than or equal to 20 dyn/cm, the spilling of ink can be effectively prevented by combined effect of the ink property and the advantages of the premised construction. Furthermore, in a range of the surface tension of the range greater than or equal to 25 dyn/cm and less than or equal to 50 dyn/cm, the foregoing effect, i,e, avoidance of environmental variation and stable characteristics can be equally obtained.

(A fifth embodiment)

Figure 7:
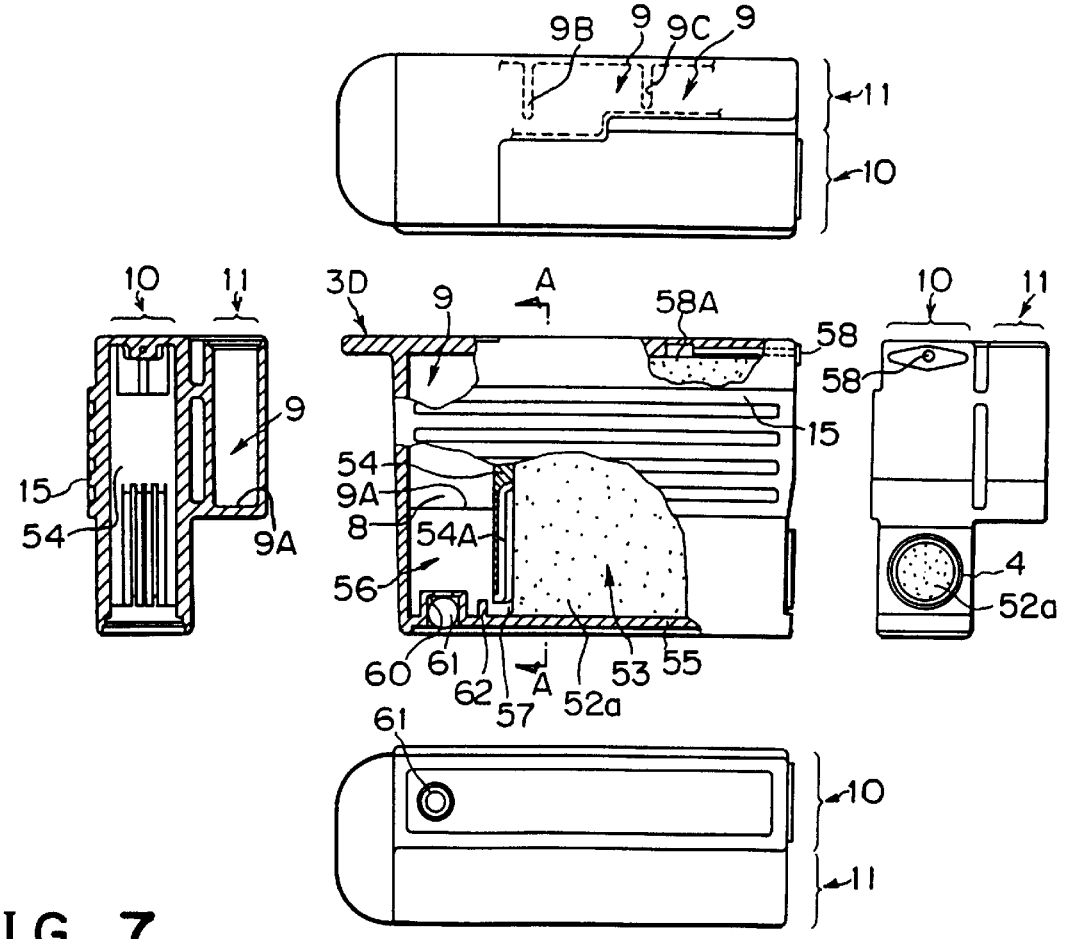
FIG. 7 is an illustration showing another embodiment of an ink cartridge according to the present invention.
Figure 8B:
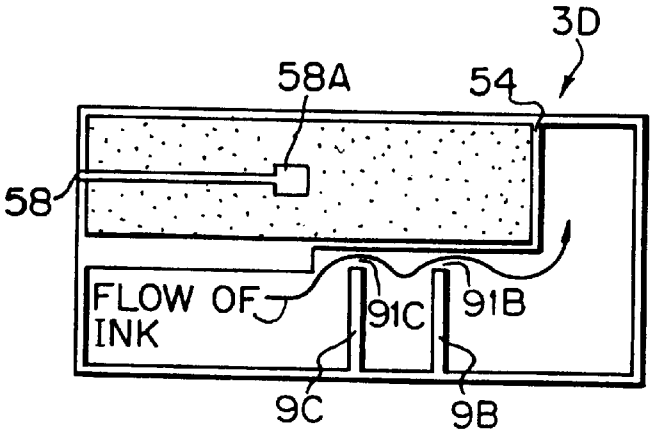
FIGS. 8A to 8C are a partially sectioned perspective view and diagrammatic illustrations.
Figure 8C:
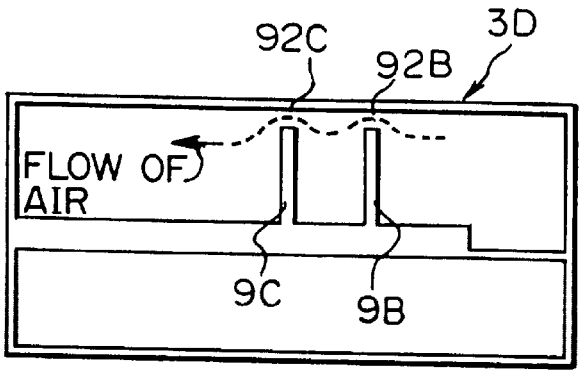
Figure 8A:
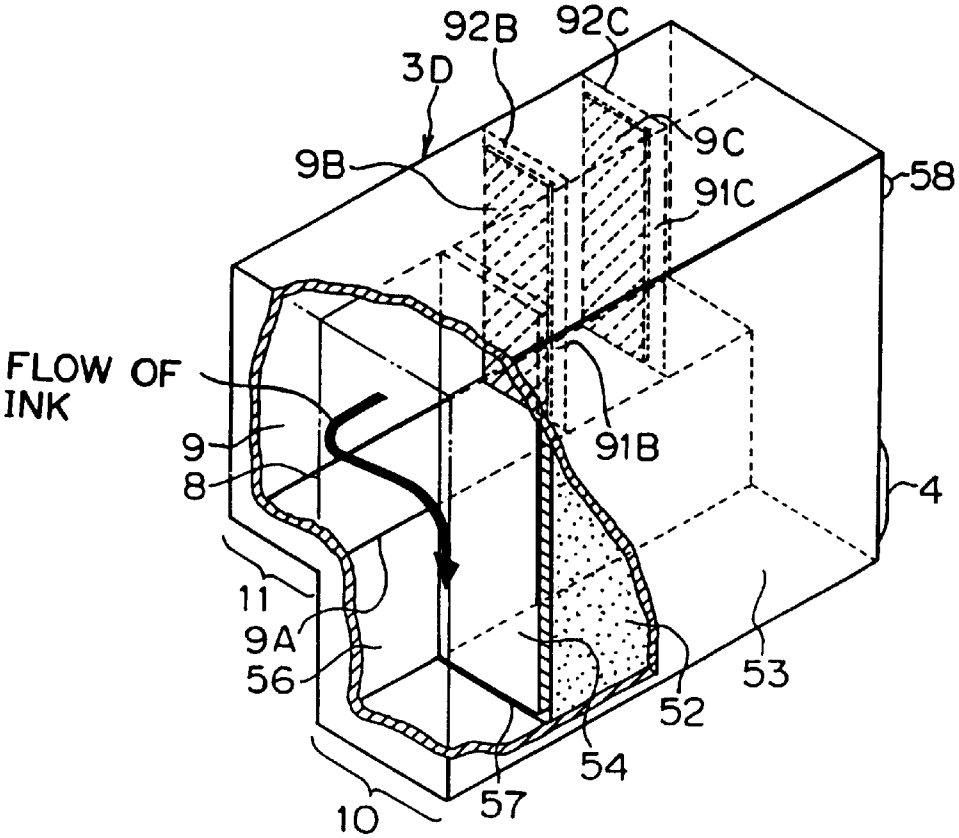

FIGS. 7 and 8A–8C show the fifth embodiment of the ink tank cartridge according to the present invention, which is the modification of the large capacity volume type ink tank cartridge 3C shown in FIG. 2. FIG. 7 show three side elevations including partially sectioned view and sections, and FIG. 8A is a partially cut-away perspective view, FIGS. 8B and 8C are sectional illustrations.

As shown in these figures, the shown embodiment of the ink tank cartridge 3D comprises a main portion 10 having substantially the same construction to the independent individual ink cartridge 3B shown in the former embodiment and a sub-portion 11 having smaller volume than the overall volume of the main portion 10.

In the main portion 10, the negative pressure generating member housing portion 53 filled with the negative pressure generating member 52*a* and an ink storage portion 56 located adjacent the negative pressure generating member housing portion 53 across the rib 54. The ink stored in the ink storage portion 56 is supplied to the negative pressure generating member housing portion 53 via the communicating portion 57 by gas-liquid exchange.

On the other hand, the sub-portion 11 is a hollow portion similarly to the above-mentioned ink storage portion 56 and constituted of the ink storage portion 9 as the enclosed ink storage portion of the present invention. The ink storage portion 9 is communicated with the ink storage portion 56 of the main portion 10 via a communication path, of which a part is shown by arrows in FIGS. 8A through 8C. Namely, the storage portion 9 and the storage portion 56 are formed into a continuous chamber. By this, the ink stored in both storage portions are supplied to the negative pressure generating member housing portion 53 via the communicating portion 57.

The construction of the ink cartridge 3D as set forth above, has substantially the same basic constriction to the ink cartridge 3C shown in FIGS. 2, 3 and 4. Namely, the construction of the half body at one side of the ink cartridge 3C shown in the foregoing embodiments include the similar construction to the main portion 10 shown in FIG. 7 and has the negative pressure generating member housing portion at one portion. On the other hand, the other half body of the ink cartridge 3C at the other side has the construction constituted of at hollow ink storage portion similarly to the sub-portion 11.

Different point between the shown embodiment of the ink cartridge 3D and foregoing embodiment of the ink cartridge 3C resides that the bottom surface 9A of the sub-portion 11 (ink storage portion 9) of the shown embodiment of the ink cartridge 3D is located at the higher elevation than the bottom surface of the main portion 10, while the former embodiment of the ink cartridge 3C has the equal bottom surface elevation.

While the shown embodiment of the ink cartridge 3D and foregoing embodiment of the ink cartridge 3C have the difference as set forth above, both may have the following advantages superior to the conventional ink cartridge which employs the ink tank construction to use the negative pressure generating member only partially.

Namely, in a conventionally known construction of the ink cartridge, there is one which has the portion corresponding to the above-mentioned sub-portion 11 (ink storage portion 9) is arranged above the portion corresponding to the above-mentioned main portion 10. In the ink cartridge of the construction set forth above, while it may achieve the advantage in not to increase the carriage space, the water head distribution (namely, ink liquid level in the storage portion) of the ink in the ink storage portion with respect to the ink supply opening (the opening similar to the opening 4 of FIG. 7) as the connecting portion to the ink-jet head, becomes relatively large so that the variation of pressure environment with respect to gas-liquid exchange associating with consumption becomes large. While the influence of such variation of the pressure may be absorbed by the negative pressure generating member, absorption cannot be always satisfactory. On the other hand, in order to satisfactorily absorb such influence, it becomes necessary for extra cost for increasing the volume of the negative pressure generating member and so forth.

In contrast, by arranging the portion corresponding to the sub-portion at the side of the portion corresponding to the main portion as in the ink cartridges 3C and 3D in the embodiments of the present invention, the water head distribution can be made as small as possible to reduce possible variation of the pressure environment associating with consumption of the ink.

Also, in the above-mentioned ink cartridges 3C and 3D, the ink stored in the portion corresponding to the sub-portion is supplied to the main portion only through the rear portion (the communication surface 8 in the embodiment of FIGS. 7 and 8A through 8C) of the cartridge, and gas-liquid exchange is performed only in the ink passage within the main portion. Therefore, it becomes possible to reduce the load of the negative pressure generating member which receives the ink supplied from ink storage portion by gas-liquid exchange. Namely, while the amount of the negative pressure generating member and the amount of gas-liquid exchange are determined in connection ejection amount of the ink-jet head and so forth, the ink receptacle amount through the gas-liquid conversion can be relative small by restricting the portion to cause gas-liquid exchange. This prevents the necessary amount of the negative pressure generating member from increasing.

In either construction of the shown embodiments of the ink cartridge 3C and 3D of the present invention, the ribs 54 of the main portion are located at relatively rearwardly shifted position (the position remote from the opening 4) so as to accommodate the sub portion (see FIGS. 7 and 8A through 8C), and the volume of the negative pressure generating member housing portion is determined to be relatively large. In this case, the space of the ink storage portion 56 of the main portion is relatively narrow, clearances between the partitioning wall 54 defining the storage portion or the wall of the cartridge container, and the other member in the container may causes a problem. Namely, when the clearance is too small, capillary force becomes large to border movement of the ink.

In the construction of the shown embodiment the ink cartridge illustrated in FIG. 7, a clearance between a projection plate 62 or an ink filling portion 60 and the rib 54 or the cartridge container wall is preferably greater than or equal to 2 mm, and more preferable greater than or equal to 3 mm, while it is variable depending upon the composition of the ink and the material of the container.

On the other hand, in the ink cartridges 3C and 3D of the present invention, it is typical to provide an inside opening 58A of the atmosphere communication opening 58 in the vicinity of center portion on the upper surface of the negative pressure generating member housing portion 53, as shown in FIG. 7. In greater detail, the position of the center of the inside opening 58A is at 12 mm from the surface, in which the opening 4 in the cartridge and at 5.5 mm from the side surface, on which the rib 15 is formed. This position where the inside opening 58A is arranged, is the most difficult position to reach upon variation of the environmental temperature condition or upon exertion of physical impact, while the ink is filled in the ink cartridge or the ink cartridge is not in use. It should be noted that the position to arrange the inside opening 58A is not specified to the position set forth above. It is desirable to position the inside opening 58A within a range of 8 mm from the center of the negative pressure generating member housing portion toward the surface where the opening 4 is formed. Even when the position of the inside opening 58A is out of the above-mentioned range, it is desirable to be within a range of 8 mm and 5 mm toward left and right from the above-mentioned range.

By considering the position to arrange the atmosphere communication opening, remarkable effect in the viewpoint of prevention of spilling of ink, particularly through the atmosphere communication opening in the construction having the negative pressure generating member housing portion and the hollow storage portion storing the ink and flow of the ink primarily from the ink storage portion to the negative pressure generating member housing portion, as in the ink cartridge of the present invention.

In addition to the advantages common to the ink cartridges 3C and 3D of the present invention as set forth above, the ink cartridge 3D as illustrated in FIGS. 7 and 8A through 8C achieves the following advantages.

Namely, in the construction of the ink cartridges in respective embodiments of the present invention, it can be generally said the following matters. Discussing in connection with the embodiment of FIGS. 7 and 8A through 8C, the ink in the ink storage portion 56 is can be left not used in a little amount. The amount of the ink to be left being not used is determined depending upon the positional relationship between the position of the lower end portion of the ribs 54 and the height of the opening portion 4, and the negative pressure generating member 52*a*.

At first, concerning the dimension of the clearance between the bottom surfaces of the ink storage portion 56 and the negative pressure generating member housing portion 53, there is a condition that the dimension is preferably about 0.1 to about 20 mm, and more preferably about 0.5 to about 5 mm for smoothing supply of the ink from the ink storage portion 56 to the negative pressure generating member housing portion 53 and supply of air in the reverse direction in viewpoint of gas-liquid exchange. In this case, if the height of the lower end of the opening portion 4 is higher than or equal to the height of the lower end portion of the rib 54, it becomes difficult to spill the ink through the opening portion 4. Therefore, it is preferred that the height of the lower end of the opening portion is higher than or equal to the height of the lower end portion of the rib 54.

Here, the amount of the ink to be left being not used is determined in the range of the height from the lower end portion of the opening portion 4 and the upper end portion thereof. Namely, when the ink is supplied to the head via the joint portion (connecting tube) 51*a* as illustrated in FIG. 6 from the opening portion 4, if the ink liquid level in the negative pressure generating member 52*a* becomes lower than or equal to the upper end of the opening portion 4, the air penetrates into the ink-jet head through the upper end portion to cause ejection failure. In such case, the use of the ink tank is terminated at that timing.

On the other hand, when the joint portion 51*a* is sufficiently inserted into the negative pressure generating member 52*a*, penetration of the air can be prevented. However, when the ink liquid level in the negative pressure generating member 52*a* becomes lower than or equal to the lower end of the opening portion 4, the further ink cannot be used. Therefore, the ink amount at that ink liquid level is left being not used.

In observation of the fact set out above, the amount of the ink to be left being not used can be reduced by decreasing the internal volume of the cartridge placed lower than or equal to the upper or lower end of the opening portion 4.

The ink cartridge 3D illustrated in FIGS. 7 and 8A through 8C is designed with taking the fact set forth above into account. Namely, by setting the position of the bottom surface 9A of the ink storage portion 9 at higher position than the lower end of the opening portion 4, preferably than the upper end of the opening portion, the internal volume of the ink cartridge to be placed lower than or equal to the upper or lower end of the opening portion 4 can be decreased. By this, the amount of the ink to be left being not used can be reduced to improve use efficiency of the ink.

The ink cartridge 3D illustrated in FIGS. 7 and 8A through 8C has two internal ribs 9B and 9C in the ink storage portion 9 and five ribs 15 at a part of the outer surface of the cartridge, in addition to the construction set forth above.

As can be appreciated from FIGS. 7 and 8A through 8C, the internal ribs 9B and 9C serves as the partitioning plates are arranged at mutually different positions to the ribs 54 of the main portion 10, in the longitudinal direction of the cartridge. By this, the strength of the cartridge can be effectively reinforced. The internal ribs 9B and 9C are provided with side slits 91B and 91C and upper slits 92B and 92C so that they will never block ink flow and air flow in the ink storage portion 9 by the presence thereof, in addition to the function set forth above. Namely, the ink from the ink storage portion 9 flows into the ink storage portion 56 of the main portion 10 primarily through the side slits 91B and 91C, and the bubble penetrating into the ink storage portion 9 by the gas-liquid exchange in the rib 54 of the main portion 10 passes the upper slits 92B and 92C at the beginning of consumption of the ink. Also, by the presence of the ribs 9B and 9C, reciprocal flow of the ink in the ink storage portion 9 and the ink storage portion 56 can be restricted.

The external rib 15 is formed through overall side surface of the main portion 10, as shown in FIG. 7. Namely, the rib 15 is extended through both regions of the ink storage portion 56 and the negative pressure generating member storage portion 53 which are differentiated natural vibration frequencies. By this, the natural vibration frequency can be averaged to absorb pressure vibration within the ink cartridge due to ejection of the ink from the ink-jet head. As a result, resonation to the pressure vibration can be suppressed. Also, smooth ink supply can be provided by absorption of the vibration.

Furthermore, the cartridge illustrated in FIGS. 7 and 8A through 8C have smaller bottom portion of the ink storage portion 56 by shifting the rib, 54 backwardly from the center portion, in comparison with the cartridge shown in FIG. 6. By this, despite of the fact that the ink storage portion is increased volume by addition of the ink storage portion 9, the remaining amount of the ink to be left being not used at the bottom portion of the storage portion 56 can be reduced.

As set forth above, in the shown embodiment of the ink cartridge, the negative pressure control means, such as the negative pressure generating member 52*a* and so forth is provided in the main portion 10, and only storage portion storing the ink is provided in the sub-portion 11. With this construction, it becomes possible to provide substantially the same performance in the ink holding ability and ink supply ability with the similar rib construction and similar design rule of the negative pressure generating member to the independent individual cartridge 3B shown in the former embodiment.

Figure 10:
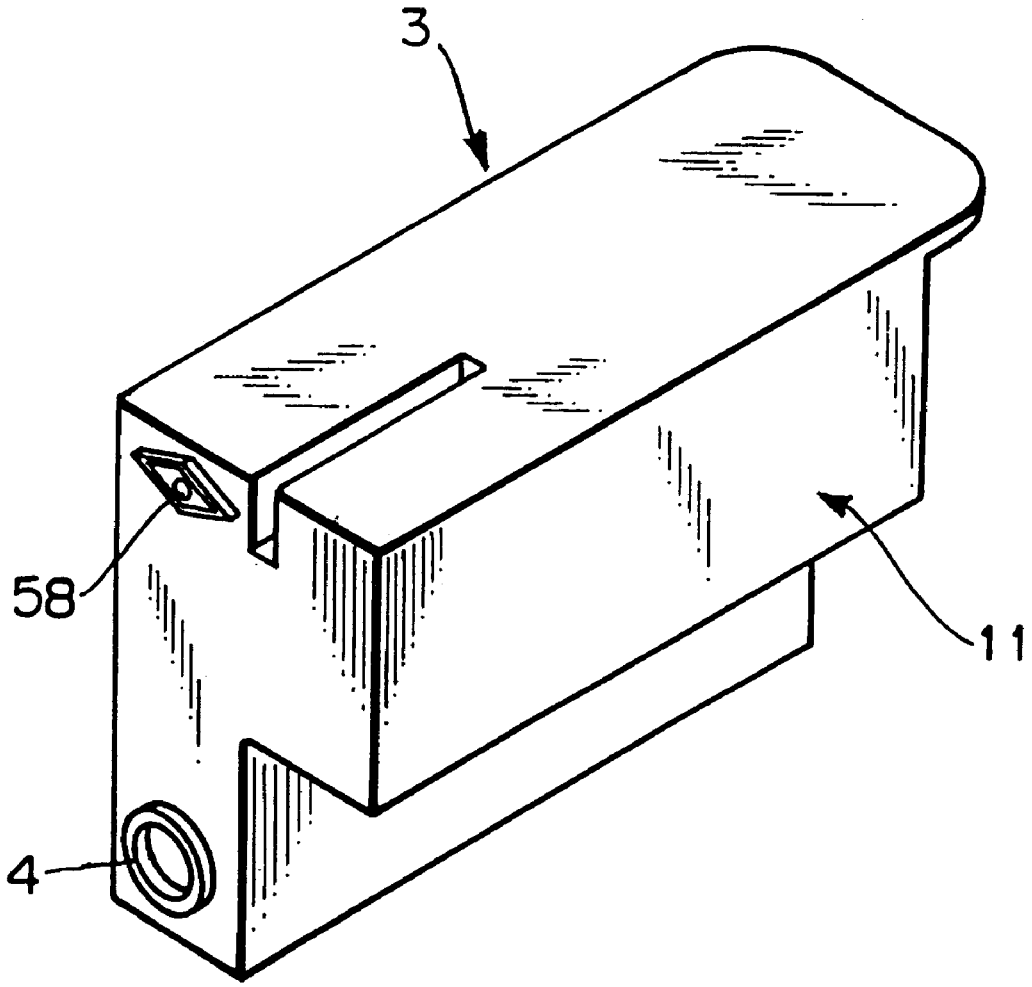
FIG. 10 is a perspective view showing an external view of the ink cartridge shown in FIGS. 7 and 8.

FIG. 10 is a perspective view showing the external view of the ink cartridge 3D of FIGS. 7 and 8A through 8C. As shown, the atmosphere communication opening 58 and the opening 4 are formed at one end of the main portion 10.

Figure 9:
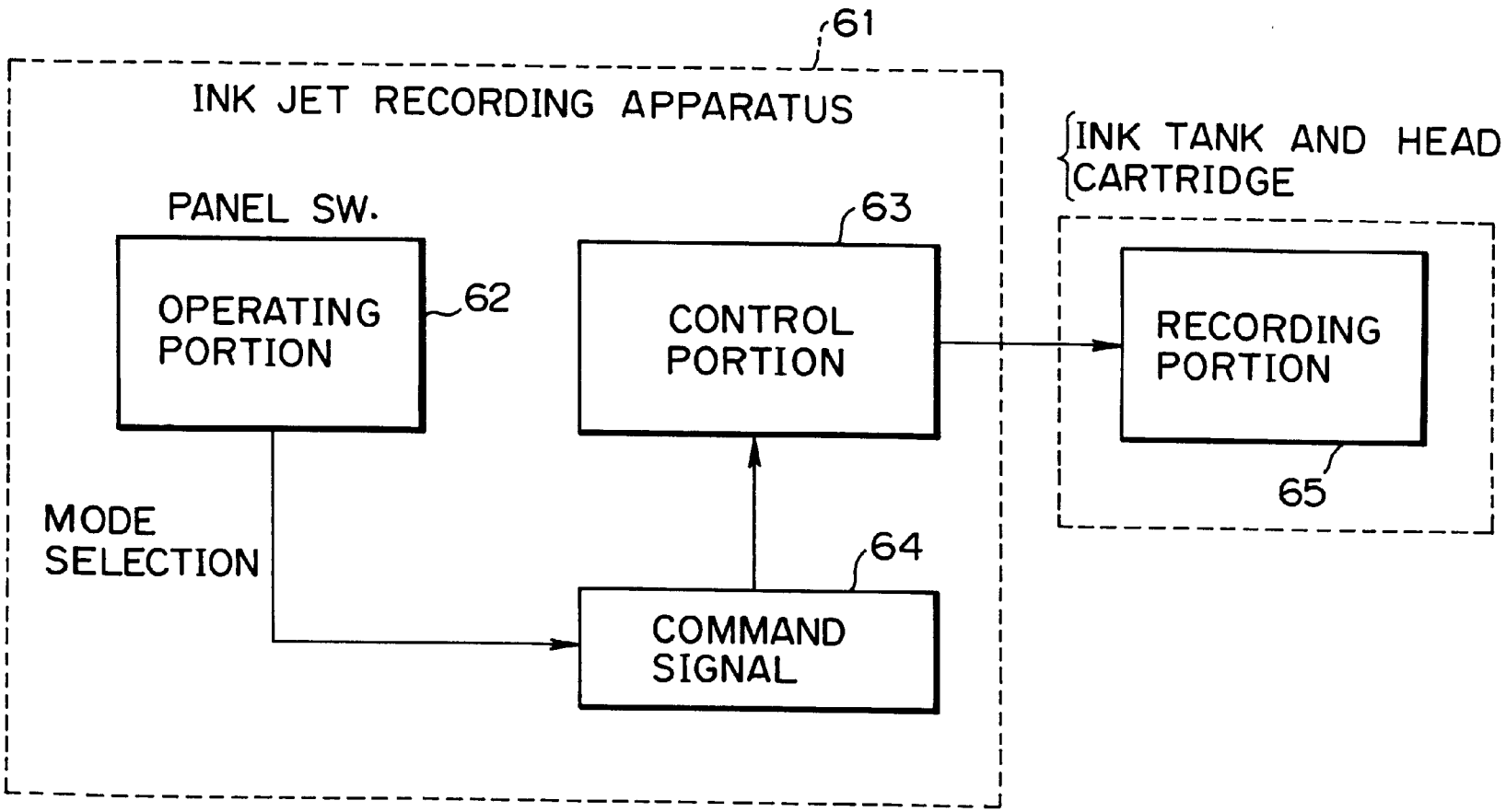
FIG. 9 is a schematic block diagram showing a control system for an ink-jet apparatus.

FIG. 9 is a block diagram showing a circuit for controlling conversion in the ink-jet recording apparatus 61 upon exchanging of the ink tank cartridges in the foregoing embodiments, and conversion of multi-tone recording, color mode, monochrome mode and so forth.

The shown embodiment is designed to permit control of the apparatus adapting to the ink tank and head cartridge installed in the recording portion 65 by inputting a command signal 64 to a control portion through manual operation of a panel operating portion 62 by user. The shown construction facilitates switching of the mode through manual control by the user. Even when the ink tank and head cartridge is exchanged, the apparatus main body can adapt the operation thereto so that the operation ability and general applicability of the ink tank and head cartridge according to the present invention can be enhanced.

Figure 11:
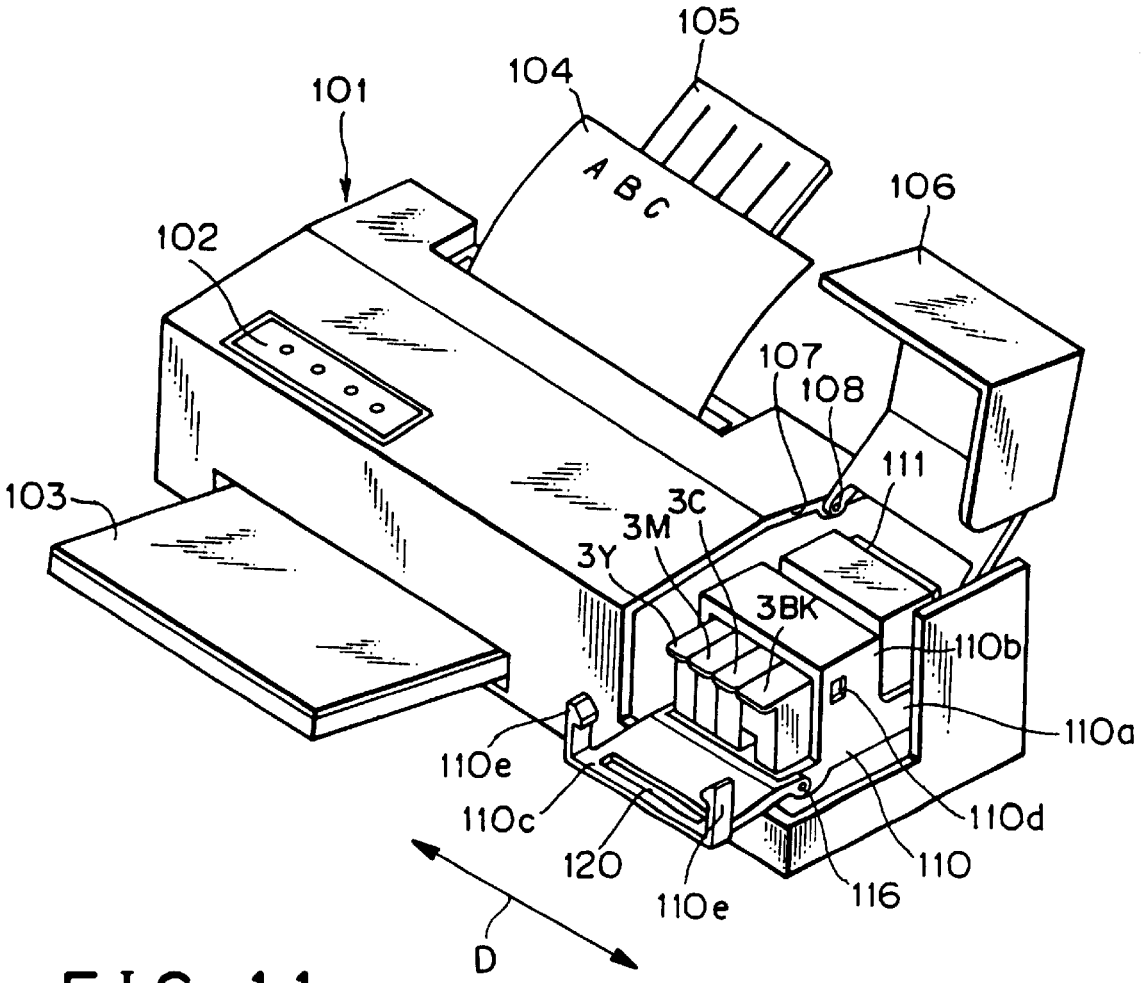
FIG. 11 is a perspective view showing one embodiment of an ink-jet apparatus according to the present invention.

FIG. 11 is a perspective view of a printer as the ink-jet recording apparatus employing the above-mentioned ink cartridge according to the invention.

In FIG. 11, the reference numeral 101 denotes a printer, 102 denotes an operation panel provided at the front upper portion of a housing of the printer 101, 103 denotes a paper feed cassette set in an opening at the front face of the housing, 104 denotes a paper (medium to be recorded) supplied from the paper feed cassette 103, 105 denotes an ejected paper tray for holding the paper ejected through a paper feeding path within the printer 101, and 106 denotes a main body cover having substantially L-shaped cross-section. The main body cover 106 is adapted to cover the opening portion 107 formed at the right front portion of the housing and pivotally mounted to the inside end of the opening 107 via a hinge 108. Within the housing, a carriage 110 supported by a guide (not shown) or so forth is arranged. The carriage 110 is provided reciprocally along the longitudinal scanning direction D of a guide or so forth in the width direction of the paper passing through the paper feeding path.

In the shown embodiment, the carriage 110 generally comprises a stage 110*a* horizontally held by the guide and so forth, an opening portion (not shown) formed in the vicinity of the guide on the stage 110*a* for installing the ink-jet head, a cartridge garage 110*b* for housing the ink cartridges 3Y, 3M, 3C and 3Bk, and a cartridge holder 110*c* for preventing the cartridge stored in the garage 110*b* from loosing out.

The stage 110*a* is slidably supported by the guide at the read end portion thereof, and the lower side of the front end portion is mounted on a not shown guide plate. It should be noted that the guide plate may be the one serving as a paper holding member for preventing the paper fed through the paper feeding path from lifting off. Also, the guide plate may be one which has a function to lift up the stage relative to the guide in cantilever fashion depending upon the thickness of the paper.

At the opening portion of the stage 110*a*, the ink-jet head (not shown) is installed with directing the ink injecting opening downwardly.

The cartridge garage 110*b* is formed with a through opening for simultaneously housing four ink cartridges 3Y, 3M, 3C and 3Bk in back-and-forth direction. At the both sides portions of the outside of the cartridge garage 110*b*, an engaging recess to engage with an engaging claw of the cartridge holder 110*c* is formed.

At the front end portion of the stage 110*a*, the cartridge holder 110*c* is pivotally mounted through a hinge 116. The dimension from the front end face of the garage 110*b* to the hinge 116 is determined in consideration of the dimension to project the cartridges 3Y, 3M, 3C and 3Bk from the front end portion of the garage 110*b* when the cartridges are housed within the garage. The cartridge holder 110*c* is of generally rectangular plate shaped configuration. For the cartridge holder 110*c*, a pair of engaging claws 110*e* projecting from the lower portion fixed by the hinge 116 for engaging with the engaging recesses 110*d* of the garage 110*b* in closure of the holder 110*c*. Also, for the cartridge holder 110*c*, an engaging hole 120 for engaging with handle portions of respective cartridges 3Y, 3M, 3C and 3Bk, in a plate portion. The position, the configuration and size of the engaging hole 120 are determined corresponding to the handle portion.

As set forth above, by employing the exchangeable ink tank for the ink-jet according to present invention, the frequency of exchanging the ink tank can be reduced can be reduced. Also, penetration of the bubble into the joint portion, and the damaging of the filter which may otherwise caused upon exchanging the cartridge, can be reduced. Also, exchanging operation can be facilitated.

With the effect set forth above, the factor which may cause instability of injection, can be eliminated to permit stable image formation.

Also, by the control on the recording apparatus main body, switching of the printing modes can be facilitated.

On the other hand, according to the present invention, it becomes possible to provide the ink tank cartridge and the ink-jet apparatus, which can permit installation of the single color ink tank cartridge and an ink cartridge containing at least two colors or increase volume capacity, with compatibility therebetween.

Accordingly, is becomes possible to provide the ink cartridge and the ink-jet apparatus adapted to the manner of use by the user.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. An ink container connectable to an ink jet recording apparatus having a recording head, said ink container comprising:

a housing having a front wall, a back wall, a top wall, a non-flat bottom wall, and first and second side walls;

a first chamber for supplying ink to the recording head, said first chamber containing negative pressure producing material and having an air vent communicating with atmosphere;

a second chamber disposed behind the first chamber in a direction from the front wall to the back wall, said second chamber providing an ink reservoir for the first chamber and communicating with the first chamber via a communication part;

a partition wall for separating the first chamber from the second chamber and for defining the communication part; and a third chamber providing an ink reservoir for the second chamber and communicating only with the second chamber, said second chamber being substantially closed except for communication with the first and third chambers;

wherein said third chamber is positioned so as to extend in a direction from the front wall to the back wall alongside said first and second chambers with the first side wall being adjacent said third chamber and with the bottom wall being shaped so that a portion of the bottom wall forming a wall of the third chamber is located at a higher level than a portion of the bottom wall forming a wall of the first and second chamber when, in use, said ink container is connected to the ink jet recording apparatus.

2. An ink container as claimed in claim 1, further comprising ambient air introducing means along said partition wall formed between said first chamber and said second chamber for introducing ambient air into said second chamber.

3. An ink container as claimed in claim 2, wherein said ambient air introducing means introduces ambient air from said air vent of said first chamber into said communication part.

4. An ink container as claimed in claim 1, wherein said third chamber includes at least one side wall and a reinforcing wall for reinforcing said third chamber, said reinforcing wall being arranged inside said third chamber and being connected substantially perpendicularly to said one side wall of said third chamber.

5. An ink container as claimed in claim 1, wherein a black ink is stored in said second chamber.

6. An ink container as claimed in claim 1, wherein ink is stored in said second chamber, the ink having a surface tension in a range between 20 dyn/cm and 55 dyn/cm.

7. An ink container as claimed in claim 1, wherein a plurality of said ink containers are mounted on a carriage and connected to a plurality of ink jet print heads, and said carriage is provided with at least one partition rib for defining at least a portion of a mounting space for at least one of said plurality of ink containers, and said at least one ink container is provided with a cutaway portion of its housing for avoiding interference with said partition rib.

8. An ink container as claimed in claim 1, containing a black ink and being used together with other ink containers containing a yellow ink, a magenta ink and a cyan ink, respectively, said other ink containers including only a first chamber and a second chamber and not a third chamber.

9. An ink container as claimed in claim 1, wherein said first chamber has a supply port for supplying the ink to the recording head, and wherein the supply port is positioned in a wall of said first chamber and has a lower portion.

10. An ink container as claimed in claim 1, further comprising a reinforcement member provided on a side wall of said first chamber and said second chamber opposite to a side wall of said second chamber, the side wall of said second chamber including an upper portion, which is integrated with a side wall of said third chamber, said reinforcement member extending through a region corresponding to both said first chamber and said second chamber.

11. An ink container as claimed in claim 10, wherein said reinforcement member is comprised by a rib.

12. An ink container as claimed in claim 1, mountable on a carriage in the ink jet apparatus for use in the ink jet apparatus, and further comprising a concave portion for engaging with a part of the carriage, said concave portion being formed by a portion of said first chamber and said second chamber and a portion of said third chamber.

13. An ink container as claimed in claim 1, wherein said first chamber has at least one groove in said partition wall extending from said communication part to a position spaced from a top of said first chamber.

14. An ink container as claimed in claim 1, wherein the first chamber has an ink supply port defined in a wall of the first chamber opposing said partition wall.

15. An ink container as claimed in claim 14, wherein said ink supply port is adapted to permit insertion of a supply tube of the recording head, said negative pressure producing material being arranged to be compressed in the vicinity of said ink supply port by insertion of said supply tube.

16. An ink container as claimed in claim 1, wherein a partition plate is positioned within said third chamber so that the partition plate is offset from the position of said partition wall and a path for movement of air and ink is provided between the partition plate and a wall of the third chamber to allow movement of ink and air.

17. An ink container as claimed in claim 1, wherein a partition plate is disposed within said third chamber so as to be spaced from the walls of said first and second chambers and so as to enable communication across said partition plate at a location which is uppermost in use of the ink container.

18. An ink container as claimed in claim 1, wherein an ink supply port is defined in a wall of said first chamber opposing said partition wall.

19. An ink container as claimed in claim 1, wherein ribs extend along a side wall of said first and second chambers for adjusting a natural vibration frequency of the ink container.

20. An ink container as claimed in claim 1, wherein volume ratios of the sum of the volumes of said second chamber and said third chamber to the volume of said first chamber is in the range of from 3:1 to 1:1.

21. An ink container as claimed in claim 1, wherein said air vent communicates with a central portion of said first chamber which is uppermost in use via an enclosed path.

22. An ink tank detachably mountable on a carriage having at least one partition rib to define respective mounting locations each of which is sized at a first size corresponding to one ink tank and each for mounting each of a plurality of ink tanks supplying an ink to each of a plurality of ink jet heads, said ink tank comprising:

a tank body, a mounting size of which is substantially twice as large as said first size, and which has an ink supply part and an ambient air communication part; and a groove which is provided at a bottom face of said tank body as a mounting face to the carriage and which receives the partition rib to avoid interference with said partition rib when said ink tank is mounted on said carriage.

23. An ink tank connectable to one of a plurality of ink jet print heads and being detachably mounted on a carriage having a mounting portion which is provided with plural partition ribs that together define a plurality of mounting locations each of which is sized to mount one ink tank, said ink tank comprising:

a plurality of ink tank parts; and an ink tank connection structure connecting plural ones of said plurality of ink tank parts, a width of the connected ink tank parts corresponding to at least two of said plurality of ink tank parts, the connected ink tank parts corresponding to at least two adjacent mounting locations in said plurality of mounting locations, wherein said ink tank includes a structure to avoid interference with an intervening one of said plural partition ribs provided between said at least two adjacent mounting locations.

24. An ink tank as claimed in claim 23, wherein said structure is a groove fitting with said intervening partition rib.

25. An ink tank as claimed in claim 23, wherein said ink tank has one ink supply port connected to one of the ink jet print heads, and said connected ink tank parts are communicated to each other through an opening disposed at a position inside said connected ink tank parts when said connected ink tank parts are connected by said connection structure, and a same kind of ink is stored in each of said ink tank parts.

26. An ink tank as claimed in claim 25, wherein said kind of ink is black ink.

27. An ink tank as claimed in claim 23, wherein said ink tank parts are not communicated to each other, and different kinds of ink are stored in each of said ink tank parts, respectively, and further comprising ink supply ports for each of said ink tank parts, respectively, each of said ink supply ports being connected to one of the ink jet print heads.

28. An ink tank as claimed in claim 27, wherein said kinds of ink include yellow, magenta and cyan ink.

29. An ink tank as claimed in claim 23, wherein said ink tank parts include a second storage portion containing an absorbing member and having an ambient air communicating portion and an ink supply portion for supplying ink to one of said plurality of ink jet print heads, and a first storage portion communicating with said second storage portion through a communicating part and storing an ink to be supplied to said second storage portion.

30. An ink tank as claimed in claim 29, wherein said plurality of ink tank parts includes parts that do not communicate with each other and store yellow, magenta and cyan inks, respectively.

* * * * *

UNITED STATES PATENT AND TRADEMARK OFFICE

CERTIFICATE OF CORRECTION

PATENT NO. : 6,179,415 B1
DATED : January 30, 2001
INVENTOR(S) : Okazaki et al.

It is certified that error appears in the above-identified patent and that said Letters Patent is hereby corrected as shown below:

Title page,
Item [56], References Cited, FOREIGN PATENT DOCUMENTS,
"1103482" should read -- 1-103482 --,"02000522" should read -- 2-00522 --;
"02198861" should read -- 2-198861 --; and "3140736" should read -- 3-140736 --.

Column 1,
Line 15, "an" should be deleted.

Column 2,
Line 40, "spills" should read -- spill --;
Line 41, "Therefor," should read -- Therefore, --;
Line 51, "knows." should read -- known. --; and
Line 60, "study for" should read -- a study of --.

Column 3,
Line 24, "uncovered." should read -- discovered. --; and
Line 60, "is" should read -- does --.

Column 4,
Line 7, "despite" should read -- inspite --; and
Line 58, "is arisen" should read -- arises --, "an" should be deleted, and "tends" should read -- tend --.

Column 5,
Line 25, "be" should read -- been --.

Column 6,
Line 24, "objects" should read -- object --.

Column 7,
Line 7, "one or arbitrary" should read -- one of, or an arbitrary --; and
Line 54, "remained" should read -- remaining --.

Column 10,
Line 37, "is" should be deleted.

Column 12,
Line 12, "make" should read -- makes --.

UNITED STATES PATENT AND TRADEMARK OFFICE

CERTIFICATE OF CORRECTION

PATENT NO. : 6,179,415 B1
DATED : January 30, 2001
INVENTOR(S) : Okazaki et al.

It is certified that error appears in the above-identified patent and that said Letters Patent is hereby corrected as shown below:

Column 13,
Line 24, insert "from" after "removed";
Line 26, "establish" should read -- establishing --;
Line 65, "contact" should read -- contacted --; and
Line 67, "use" should read -- have --.

Column 14,
Line 18, "preferable" should read -- preferably --; and
Line 29, "is" should be deleted and "occurred" should read -- occurs --.

Column 15,
Line 11, "show" should read -- shows --.

Column 16,
Line 5, "not to increase" should read -- not increasing --;
Line 39, "relative" should read -- relatively --; and
Line 54, "causes" should read -- cause --.

Column 17,
Line 36, "is" should be deleted.

Column 20,
Line 27, "caused" should read -- be caused --;
Line 40, "is" should read -- it --; and
Line 51, "embodies" should read -- embodied --.

Signed and Sealed this

Fifth Day of March, 2002

*Attest:*

*Attesting Officer*

JAMES E. ROGAN
*Director of the United States Patent and Trademark Office*